US011384634B2

(12) United States Patent
Lanticq et al.

(10) Patent No.: US 11,384,634 B2
(45) Date of Patent: Jul. 12, 2022

(54) MAINTENANCE DEVICE AND METHOD FOR DETERMINING THE POSITION OF A BLOCKAGE POINT OF A TUBULAR MEMBER

(71) Applicants: FEBUS OPTICS, Pau (FR); DRILLSTAR INDUSTRIES, Lons (FR)

(72) Inventors: Vincent Lanticq, Pau (FR); Pierre Clément, Pau (FR); Tarek Marion Lamazouade, Pau (FR); Raphaël Souchal, Lons (FR); Cédric Cabé, Assat (FR)

(73) Assignees: FEBUS OPTICS, Pau (FR); DRILLSTAR INDUSTRIES, Lons (FR)

( * ) Notice: Subject to any disclaimer, the term of this patent is extended or adjusted under 35 U.S.C. 154(b) by 61 days.

(21) Appl. No.: 16/907,384

(22) Filed: Jun. 22, 2020

(65) Prior Publication Data

US 2020/0400012 A1 Dec. 24, 2020

(30) Foreign Application Priority Data

Jun. 21, 2019 (FR) ..... 1906764

(51) Int. Cl.
*E21B 47/09* (2012.01)
*E21B 47/002* (2012.01)
(Continued)

(52) U.S. Cl.
CPC ..... *E21B 47/09* (2013.01); *E21B 47/0025* (2020.05); *E21B 47/01* (2013.01); *E21B 47/135* (2020.05)

(58) Field of Classification Search
CPC .... E21B 17/023; E21B 17/1035; E21B 19/12; E21B 23/01; E21B 47/0025;
(Continued)

(56) References Cited

U.S. PATENT DOCUMENTS 5,988,286 A * 11/1999 Dwiggins ..... E21B 17/10 166/382
7,389,183 B2 * 6/2008 Gray ..... E21B 47/09 702/6
(Continued)

FOREIGN PATENT DOCUMENTS

CN 106351646 A 1/2017
CN 107701174 A * 2/2018
(Continued)

OTHER PUBLICATIONS

Preliminary Search Report issued in FR 1906764 dated Apr. 22, 2020 (9 pages).

*Primary Examiner* — Jennifer H Gay
(74) *Attorney, Agent, or Firm* — Pearne & Gordon LLP

(57) ABSTRACT

The invention relates to a maintenance device (1) for determining the position of a blockage point (2) of a tubular member (3), characterized in that it includes a fiber-optic cable (40) and a plurality of holding guides (20), each holding guide (20) being attached to the fiber-optic cable (40) and including a means (21) for attaching to the tubular member (3).
The invention also relates to a method and a system for determining the position of a blockage point of a tubular member.

22 Claims, 9 Drawing Sheets

(51) Int. Cl.
*E21B 47/135* (2012.01)
*E21B 47/01* (2012.01)

(58) Field of Classification Search
CPC ..... E21B 47/007; E21B 47/01; E21B 47/09; E21B 47/135; F16L 3/08; F16L 3/12; F16L 3/22
See application file for complete search history.

(56) References Cited

U.S. PATENT DOCUMENTS 7,660,197 B2 2/2010 Barolak
7,849,928 B2 * 12/2010 Collie ..... E21B 19/22 166/378
8,919,436 B2 * 12/2014 Wheater ..... E21B 17/10 166/241.5
9,222,349 B2 * 12/2015 LeBlanc ..... E21B 33/16
9,234,394 B2 * 1/2016 Wheater ..... E21B 17/1057
11,125,025 B1 * 9/2021 Wheater ..... E21B 17/1035
2005/0240351 A1 * 10/2005 Gray ..... E21B 47/09 702/6
2008/0060808 A1 3/2008 Gibson
2012/0018145 A1 * 1/2012 Wheater ..... E21B 17/206 166/241.5
2012/0031609 A1 * 2/2012 Wheater ..... E21B 17/1057 166/241.5
2012/0230151 A1 * 9/2012 Almaguer ..... E21B 7/061 367/86
2013/0094798 A1 * 4/2013 Duncan ..... G01L 1/246 385/13
2014/0034301 A1 * 2/2014 Leblanc ..... E21B 33/16 166/250.14
2018/0245957 A1 8/2018 Farhadiroushan
2020/0263536 A1 * 8/2020 Tubel ..... E21B 47/12
2020/0400012 A1 * 12/2020 Lanticq ..... E21B 47/01

FOREIGN PATENT DOCUMENTS

WO 2013134201 A1 9/2013
WO WO-2016195706 A1 * 12/2016 ..... E21B 41/00
WO 2017064472 A1 4/2017
WO WO-2017064472 A1 * 4/2017 ..... E21B 47/092

* cited by examiner

MAINTENANCE DEVICE AND METHOD FOR DETERMINING THE POSITION OF A BLOCKAGE POINT OF A TUBULAR MEMBER

The invention relates to the field of subsoil exploitation such as mining and oil exploitation, and more particularly to the field of drilling. The invention relates to a maintenance device for determining the position of a blockage point of a tubular member, preferably in a borehole. The invention also relates to a method for determining the position of a blockage point of a tubular member in a borehole.

PRIOR ART

Drilling has been used for years to dig holes in the earth. Generally speaking, drilling refers to all the techniques for digging or drilling the earth to great depths, as well as the result of their application. Historically, drilling has made it possible to find and exploit resources such as water. Then, over the years, drilling techniques developed with the exploitation of other resources such as oil and gas. New fields of application using drilling techniques have also emerged, such as geothermal energy, geotechnics, the environment, and also scientific research.

Generally speaking, drilling consists of digging using a rotary drill bit arranged at the end of a tubular member such as a pipe string or drill string, through layers of earth and rock. As the drilling progresses, drill pipes are used to advance the borehole deeper. However, as the drilling progresses, it is not uncommon for the drill pipe to become jammed, particularly due to ground collapse, bringing drilling operations to a halt.

Due to the length of the tube, the difficulty of access and clearance, it is difficult, if not impractical, to clear the one or more blocked sections.

In order to achieve clearance, it is common practice to back off or cut the string at a specific location to retrieve as many drill rods and equipment as possible for later use, or to abandon the string at the blockage point. These solutions are far-reaching, time-consuming, costly, putting at risk the safety of operators and the stability of the borehole. It is therefore necessary to precisely know the blockage point of a drill pipe in order to limit these consequences.

The current techniques, developed by oil groups, are based on a tool commonly called FPI ("Free Point Indicator" in Anglo-Saxon terminology). This tool can be used to determine where the drill pipe is blocked so that it can subsequently be freed, for example, by means of explosives. To this end, the tool is removably attached to the inner walls of the drill pipe which is under tensile or torsional stress. The FPI measures deformations that allow for the estimation of the blockage point of the drill pipe. Nevertheless, this tool measures only a few meters each time, requiring a large number of measurements to cover the entire tube to be carried out. In addition, the descent protocol is long and can last up to several hours, to determine the blocked portion. Moreover, this technology is particularly expensive and fragile due to the electronics and mechanical systems on board.

Another system called HFPT ("Halliburton Free Point Tool" in Anglo-Saxon terminology) also makes it possible to determine the position of a blockage point in a borehole. To this end, this tool measures a reference magnetic value and a magnetic value after a stress is exerted on the drill pipe, and then a comparison of these measurements is made. However, this system also requires complex electrical equipment. Another technique based on magnetic sensors consists in marking magnetic markers in the casing which are then read by the magnetic sensors when the drilling system is raised. This technique requires specific and expensive equipment. Such a method is for example shown in document US2008060808.

Techniques using acoustic sensors have also been implemented. To this end, and as described in document U.S. Pat. No. 7,660,197, transmitters configured to generate and receive acoustic waves were used. Depending on the speed and direction of propagation of the acoustic waves, it seems possible to determine a stress in the drill pipe. However, these stress-determining techniques do not allow to reveal the position of the blockage point reliably and accurately in a pipe. In addition, several sensors are required, resulting in additional operating costs and total drilling downtime, which is often excessive. For example, according to document U.S. Pat. No. 7,389,183, acoustic and magnetic permeability data on a stressed or unstressed pipe are compared to determine the nature and location of the blockage. These techniques require several acoustic and magnetic measurements to be carried out, both in the presence of stress and without stress. In addition, the data collected must be analyzed and compared with each other, which further increases the time of use and complexity of the system. In addition, these techniques are time-consuming and costly due to the plurality of sensors and equipment required. In addition, they require significant drilling downtime.

Other techniques using optical fiber have also been developed. To this end, a first optical fiber is wound around the upper end of the drill pipe and a second optical fiber is also wound around the lower end od the drill pipe; then, a torsion is applied and measured. These techniques require descending the pipe little by little and making spot measurements along the tube. In addition, explosives are also required to release the rod when it is stuck (CN106351646). However, these techniques are just as time-consuming, require several measurements and point-to-point measurements. This tool measures only a few meters each time, requiring a large number of measurements to cover the entire tube. In addition, the descent protocol is long and can last up to several hours, to determine the blocked portion. Moreover, this technology requires significant drilling downtime.

Thus, there is a need for new systems and methods for determining a blockage point of a tubular member in a borehole that can address the problems caused by existing methods.

Technical Problem

The invention therefore aims to overcome the disadvantages of the prior art. In particular, the invention is intended to provide a maintenance device for determining the position of a blockage point of a tubular member. Where this device is suitable for use in a borehole, inexpensive, especially due to the short drilling downtime, and can be quickly lowered into the borehole. In addition, the device makes it possible to check in a single measurement several tens of meters, preferably a hundred meters.

The invention is further intended to provide a method for determining the position of a blockage point of a tubular member by means of a maintenance device, said method being quick and simple to implement, with a reduced number of measurements, and making it possible to control costs in particular by reducing the downtime of the drilling apparatus and personnel involved.

BRIEF DESCRIPTION OF THE INVENTION

To this end, the invention relates to a maintenance device for determining the position of a blockage point of a tubular member, characterized in that it includes a fiber-optic cable and a plurality of holding guides, each holding guide being attached to the fiber-optic cable and including means for attaching to the tubular member, in particular to an inner wall of the tubular member.

Implementing a fiber-optic cable provides a completely passive device and therefore no electrical system is lowered into the borehole. This improves the safety of operators, installations, and drilling. In addition, the fiber-optic cable allows in particular, thanks to the optical fiber, an easy measurement of the deformation. Measurements are more accurate, precise, and reliable.

The holding guides allow the fiber-optic cable to be secured to the drill pipe, preferably to the inner walls of the drill pipe.

According to other optional features of the maintenance device:

- it includes a safety cable and each holding guide is arranged so as to allow a translational movement of the holding guides with respect to the safety cable. This feature increases the robustness of the maintenance device. In addition, this allows a degree of freedom between the safety cable and the holding guides, resulting in the safety cable sliding inside each holding guide. This degree of freedom allows the fiber-optic cable to be released during measurement.
- it includes a plurality of stops, each stop being coupled to the safety cable and to one of the holding guides so as to limit the movement of said holding guide with respect to the safety cable. This allows to increase and improve the safety of the maintenance device, both during descent into the tubular member of the maintenance device and during ascent. The stops allow to improve protection and safety by providing protection for the fiber-optic cable by preventing too great a tensile force from being imposed on it.
- it includes a plurality of pairs of stops, each stop of a pair of stops being coupled to the safety cable and being positioned on either side of one of the holding guides, respectively, so as to limit the movement of said holding guide with respect to the safety cable. The plurality of pairs of stops allows to limit the movement of each holding guide with respect to the safety cable. This also allows to increase and improve the safety of the maintenance device, both during descent into the tubular member of the maintenance device and during ascent. The stops allow to improve protection and safety by providing protection for the fiber-optic cable by preventing too great a tensile force from being imposed on it. For example, each stop can be positioned at least a few centimeters upstream and/or downstream of each holding guide.
- the holding guide can comprise a conduit formed in the holding guide to accommodate the safety cable. Also, the conduit formed in the holding guide to accommodate the safety cable protrude into the holding guide along its entire length and preferably in its center.
- the attachment means is selected from: a mechanical attachment means, a magnetic attachment means, an electromagnetic attachment means, a chemical attachment means, preferably an adhesive attachment means. The attachment means allows the fiber-optic cable to be indirectly attached to the tubular member and more precisely to an inner wall of the tubular member. The attachment means for attaching the holding guides can allow a reversible attachment to the inner wall of the tubular member. Also, each holding guide comprise a central portion and the attachment means is arranged at the periphery of the central portion of each holding guide.
- the attachment means correspond to a magnet, a plurality of magnets, permanent magnets, electromagnets, plasto-magnets, moving members, or combinations thereof, configured to attach to the tubular member.
- the holding guides comprise magnets and a clamping system. The magnets allow to secure the holding guides to the tubular member. The clamping system allows to hold the fiber-optic cable onto the holding guides. The holding guides then allow to secure the fiber-optic cable to the tubular member without the use of mobile and/or electrical mechanisms.
- the safety cable is a cable made of steel (for example standard or stainless steel), composite materials, or textile materials. This ensures the robustness of the maintenance device and provides protection for all components. Indeed, advantageously, the safety cable is configured to withstand at least the entire weight of the device plus a safety coefficient to take into account the maneuvering hazards (for example traction, impact . . . ).
- it further comprises one or more ballasts. The ballast allows the maintenance device to be lowered into the borehole. This ensures that the two cables, the plurality of holding guides, and the plurality of pairs of stops or the plurality of stops, are fully lowered into the borehole. In addition, the ballast allows tensioning the one or more safety and fiber-optic cables.
- the holding guides have a longitudinal shape and are crossed along their length by the safety cable. This ensures that the device is perfectly safe. In addition, this allows a degree of freedom for the safety cable and avoids any risk of the device breaking.
- each holding guide comprises a conduit adapted to the fiber-optic cable, to accommodate the fiber-optic cable. This feature allows to secure the fiber-optic cable and increase the quality and reliability of the attachment.
- the holding guides are spaced apart from each other by a distance of the order of the size of a section of the tubular member, preferably a holding guide is spaced of less than meters from the next holding guide. This will improve resolution and precision of the solution.
- the holding guides have a longitudinal shape with two ends and a central portion, and the holding guides have at their ends a cross-sectional diameter smaller than the cross-sectional diameter of the central portion. This makes it easier to make any reductions in the diameter of the tubular member.
- it further comprises equipment for measuring pressure and/or temperature and/or acoustics. These one or more pieces of equipment allow additional data to be collected to further determine the position of a blockage point of a tubular member, but also to monitor and control the tubular member or the blockage point.

According to another aspect, the invention relates to a system for determining the position of a blockage point of a tubular member including a reflectometry distributed measurement device and a maintenance device according to the invention, said reflectometry distributed measurement device being connected to the maintenance device and configured to carry out a deformation measurement of the tubular member. The system makes it possible to determine the position of a blockage point easily and quickly. Indeed, such a system makes it possible to carry out only one set of measurements. In addition, the measurements are precise, accurate, and reliable. This also allows the deformation of the optical fiber to be measured along its entire length so that it can be determined where the tubular member is blocked.

According to another aspect, the invention relates to a method for determining the position of a blockage point of a tubular member by means of a maintenance device comprising a fiber-optic cable and a plurality of holding guides, each holding guide being attached to the fiber-optic cable and including a means for attaching to the tubular member, preferably to an inner wall of the tubular member, the maintenance device being inserted into the tubular member and the holding guides being attached to the tubular member by means of the attachment means, said method comprising:

- a step of a first reflectometry distributed measurement,
- a step of applying a stress to the tubular member or of removing a stress applied to the tubular member prior to the step of the first reflectometry distributed measurement,
- a step of a second reflectometry distributed measurement, and
- a step of determining the position of the blockage point of the tubular member by comparing the first and second reflectometry measurements.

A method according to the invention makes it possible to check in a single measurement typically a hundred meters of a tubular member. This saves a considerable amount of time. In addition, the measurements are reliable, accurate, and precise. Furthermore, the method according to the invention does not require successive anchoring steps at different heights of the walls of the tubular member to carry out the measurements. The maintenance device can therefore be lowered several meters or even hundreds of meters down the tubular member before carrying out the measurements necessary to determine the position of a blockage point. This again saves a considerable amount of time and reduces the use of expensive and specific equipment. In addition, the method is safe as it does not require the use of an active sensor or an active anchoring.

According to Other Optional Features of the Method:

- the deformation measurement steps include calculating the Brillouin backscattering in the optical fiber by means of a deformation distributed measurement device. This allows measurements to be carried out in real time and autonomously. In addition, such a step is low in energy consumption.
- it further comprises a step of measuring the length of the unwound fiber-optic cable. This avoids any overlength of one cable in relation to the other. This minimizes the risk of breakage.
- it further comprises an acoustic measurement step using Rayleigh backscattering measuring equipment. This step allows data to be collected to further determine the position of a blockage point of a tubular member, but also to monitor and control the tubular member or the blockage point.
- it further comprises a pressure measurement step using Brillouin and/or Rayleigh backscattering measuring equipment. This allows data to be collected to further determine the position of a blockage point of a tubular member, but also to monitor and control the tubular member or the blockage point.
- it further comprises a temperature measurement step using Brillouin backscattering measuring equipment. This step allows data to be collected to further determine the position of a blockage point of a tubular member, but also to monitor and control the tubular member or the blockage point.

According to another aspect, the invention relates to a tubular member comprising a maintenance device according to the invention for determining the position of a blockage point of said tubular member.

Other advantages and features of the invention will appear upon reading the following description given by way of illustrative and non-limiting example, with reference to the appended figures.

DESCRIPTION OF THE INVENTION

Figure 1:
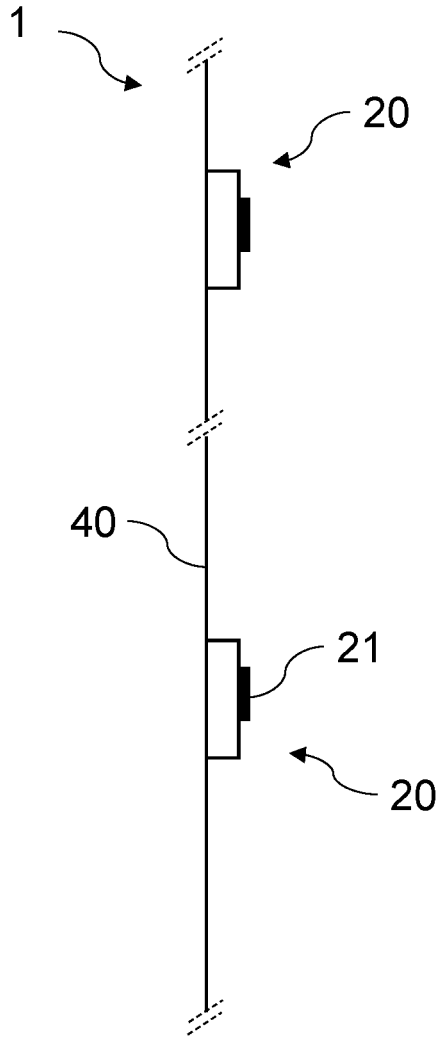
FIG. 1 represents a diagram of an embodiment of the maintenance device according to the invention.

In the remainder of the description, the expression "blockage point" corresponds to the jamming of a tubular member, for example in a borehole, preventing this tubular member from advancing. A blockage point may, for example, be the result of a rockfall, restriction, or deformation of the rock formation.

By "drilling", within the meaning of the invention, is meant the action of drilling and/or its result.

By "position", within the meaning of the invention, is meant a precise location in the space occupied by the blockage point, for example over the entire height of the borehole, and therefore more particularly a depth or distance from the surface.

The term "tubular member", within the meaning of the invention, preferably corresponds to a drill rod used for drilling a well, a casing, or tubing. However, a tubular member may also correspond to a part, object, or conduit, the length of which is greater than the width, for example cylindrical or rectangular in shape. Thus, this term can also correspond to any equipment that is part of the drill or completion string, such as a stabilizer, drill collar, packer, hanger, or heavy weights By "stress", within the meaning of the invention, is meant a force applied to a material or body. This force may be exerted by torsion, traction, thrust, or any other force resulting in "deformation" or displacement of the material or body on which it is exerted.

By "deformation" is meant a change in the shape or dimension of a material or body without exceeding the breaking point of the material or body in question. For example, a deformation, within the meaning of the invention, tends to stretch or compress a material or body undergoing a force and in particular in the form of a stress.

The terms "fixed", "attached", or "attach", within the meaning of the invention, correspond to the direct or indirect association of one member with respect to another without movement of these members with respect to each other, irremovable or removable with one or more intermediate members. Two members can be attached mechanically, electrically, or linked by a communication channel.

The terms "coupled" or "assemble" and their derivatives within the meaning of the invention, correspond to the attachment, the direct or indirect, mobile or immobile, irremovable or removable connection with one or more intermediate members. Two members can be coupled mechanically, electrically, or linked by a communication channel.

By "linked", within the meaning of the invention, is meant a connection between at least two members, where the connection can be physical, electrical, or digital.

The term "removable", within the meaning of the invention, corresponds to the ability to be detached, removed, or disassembled easily without having to destroy the means of attachment either because there is no means of attachment or because the means of attachment can be easily and quickly disassembled (for example notch, screw, tongue, lug, clips). For example, by removable, is to be understood that the object is not attached by welding or any other means not intended to allow the object to be detached.

By "pass through", within the meaning of the invention, is meant the penetration of a device from one end to the other, preferably in the longitudinal direction of the device and in its center. A degree of freedom, preferably a translational movement along the longitudinal axis of the device may be allowed.

By the expression "a single set of measurements", within the meaning of the invention, is meant the absence of a succession of different types of measurements. It is a single type of measurement, carried out by reflectometry. Thus, within the meaning of the invention, a single measurement corresponds to carrying out measurements by reflectometry without moving the maintenance device, making it possible to identify the position of a blockage point.

By "process", "calculate", "display", "extract", "compare", "measure", or more broadly "executable operation", within the meaning of the invention, is meant an action performed by a device or a processor unless the context indicates otherwise. In this respect, operations relate to actions and/or processes in a data processing system, for example a computer system or an electronic computing device, which manipulates and transforms data represented as physical (electronic) quantities in the memories of the computer system or other devices for storing, transmitting, or displaying the information. These operations can be based on applications or software.

By "essentially", within the meaning of the invention, is meant at least 50% of the constitution, preferably at least 70% of the constitution, more preferably at least 90% of the constitution, even more preferably at least 95% of the constitution.

By "accurate", "reliable", "precise", within the meaning of the invention, are meant preferably repeatable and precise measurements of the position of the blockage point, the accuracy of which is, for example, of the order of one meter.

In addition, the different features presented and/or claimed can be advantageously combined. Their presence in the description or in different dependent claims does not exclude this possibility.

Current solutions for determining the position of a blockage point of a tubular member are generally long, laborious, and expensive. In addition, they often require the insertion into the tubular member of expensive and risky electronic equipment, particularly in the context of hydrocarbon drilling.

Thus, the inventors have developed a new maintenance device for determining the position of a blockage point of a tubular member in a borehole, allowing for fast and reliable, accurate and precise measurements, and also increased safety (without any electrical system lowered into the borehole).

The invention is to be described in the context of a blockage of a tubular member in a borehole. The invention is not, however, limited to this example, and can find applications in any configuration in which there is a blockage of equipment during drilling.

In the remainder of the description, the same references are used to refer to the same elements.

According to a first aspect, the invention relates to a maintenance device 1 for determining the position of a blockage point 2 of a tubular member, preferably a drill pipe. A maintenance device 1 according to the invention makes it possible to overcome the difficulties encountered with prior art systems. The implementation of a maintenance device 1 according to the invention is perfectly adapted for use in subsoil exploitation such as mining and oil exploitation, and more particularly drilling.

Indeed, a maintenance device 1 according to the invention is completely passive and therefore no electrical system is lowered into the borehole. This also helps to secure the drilling site such as the borehole, operators, and installations. In addition, the maintenance device 1 ensures high resistance.

A maintenance device 1 may be, according to a preferred embodiment of the invention, a cable, but the invention is not limited to a cable. Indeed, any type of device comprising a fiber-optic cable 40 and a plurality of holding guides 20 can be implemented.

FIG. 1 schematizes an embodiment of a maintenance device 1 according to the invention. As shown, the maintenance device 1 includes a fiber-optic cable 40 and a plurality of holding guides 20.

The maintenance device 1 includes a plurality of holding guides 20.

Each holding guide can include a means 21 for attaching to the tubular member. Preferably the attachment means 21 allows the fiber-optic cable 40 to be attached to the tubular member and more precisely to an inner wall of the tubular member. This attachment between the tubular member and the fiber-optic cable 40 by means of the means 21 for attaching to the holding guides 20 is preferably fixed and removable. The attachment means 21 is preferably arranged at the periphery of the central portion 20C of each holding guide 20.

The attachment means 21 is selected from: a mechanical attachment means, a magnetic attachment means, an electromagnetic attachment means, a chemical attachment means, preferably an adhesive attachment means. A mechanical attachment means can for example be selected from: anchor, moving arm, clamp, or packer. A magnetic attachment means can for example be selected from: permanent magnet, electrostatic device. An electromagnetic attachment means can for example be selected from: an electromagnetic device, electromagnet. A chemical, preferably adhesive, attachment means can for example be selected from: permanent adhesive, temporary adhesive, glue, tape, adhesive.

Thus, in particular, an attachment means 21 may correspond to a magnet, a plurality of magnets, permanent magnets, electromagnets, plasto-magnets, moving members, or combinations thereof, configured to attach to the tubular member, preferably an inner wall of the tubular member. Preferably, the attachment means 21 is a plurality of permanent annular magnets 22. These magnets 22 can be coupled with a rod 24. The magnets 22 of the plurality of magnets on the rod 24 can be separated by a gap 23 in order to limit the direct interaction between two magnets 22. In addition, the number of magnets 22 of the plurality of magnets can be a function of the configuration of the tubular member. Indeed, depending on the desired friction force, the number of magnets 22 of the plurality of magnets will be high if the friction force is to be high or reduced if the desired friction force is to be low. Alternatively, the number of magnets 22 of the plurality of magnets can also be a function of the features of the tubular member.

In addition, the holding guides 20 can be attached to the fiber-optic cable 40. The plurality of holding guides 20 may be spaced apart from each other by a distance of the order of the size of a section of the tubular member. For example, each holding guide 20 is spaced 20 meters, preferably 15 meters, and more preferably 10 meters, from the next holding guide 20. For example, each holding guide 20 is spaced of less than 20 meters, preferably of less than 15 meters, and more preferably of less than 10 meters, from the next holding guide 20. The distance separating two holding guides 20 is even more preferably greater than 2 meters. The distance between two holding guides 20 allows to give the spatial resolution, when carrying out measurements. For example, a distance of 2 meters between two holding guides gives a spatial resolution of measurement of 2 meters equal to the spacing between two holding guides 20.

A fiber-optic cable 40 generally consists of at least a core, an optical sheath, and a cladding. One or more armatures of the fiber-optic cable 40 can be provided.

The core of the fiber-optic cable 40 is used to transport the optical signals between a light source and a receiver. The core can be made of glass or polymer and differs by its diameter. Thus, the core of the fiber-optic cable 40 according to the invention may correspond to a multimode optical fiber or to a single-mode optical fiber or to a multi-core fiber. The core can be for a multimode fiber of 62.5/125 μm (micrometer), of 50/125 μm, or of 9/125 μm for a single-mode fiber. Preferably, the type of fiber-optic cable is specific for the deformation measurement. For example, it can be a tight buffered type fiber cable, for a fiber clamped in the armature, or a loose-type fiber cable, that is to say the fiber is free of any stress inside the armature, for a measurement of temperature and/or acoustic vibrations.

The optical sheath surrounds the core of the optical fiber. The sheath allows to retain the light waves while allowing circulation along the entire length of the fiber. In addition, the sheath can be used to cause refraction.

The cladding can be made of polymer. It surrounds the sheath and provides protection for the optical fiber, in particular by absorbing the shocks that the fiber-optic cable 40 may be subjected to during its descent or ascent in a borehole. The thickness of the cladding, for example, is between 250 μm and 900 μm.

Alternatively, the fiber-optic cable 40 has a fiber-optic cable armature. Preferably, this armature of the fiber-optic cable 40 is structured. This improves the attachment of the fiber-optic cable to the holding guides 20. Indeed, this increases the coefficient of friction with the attachment means 27 by compressing the holding guide. This also improves the sensitivity of the deformation measurement.

Preferably, the fiber-optic cable is of the "tight-buffered" type. This allows to isolate and protect the optical fiber. In addition, a "tight-buffered"-type fiber-optic cable allows improved measurement of the fiber-optic cable deformations.

The length of the fiber-optic cable 40 can be of the order of the depth of a borehole. For example, a length of the fiber-optic cable can be 5 km (kilometer).

A fiber-optic cable 40 is used to transport optical signals between a light source and a receiver.

Furthermore, the fiber is preferably secured to the outside armature of the fiber-optic cable, which allows to improve the sensitivity of the measurements. This provides measurements that are precise, to the meter or even the centimeter, reliable, and accurate.

The fiber-optic cable 40 can be attached to the tubular member by means of the holding guides.

In addition, one end of the fiber-optic cable 40 may comprise a sealing device 41 for sealing the end of the fiber-optic cable. This device 41 can be larger in diameter than the holding guides 20. This feature allows to prevent the sealing device from passing through the holding guides. The sealing device 41 also allows the fiber-optic cable 40 to be held in the holding guides. Preferably, the sealing device can also be used to limit the movement of the fiber-optic cable. This is advantageous because the sealing device allows to seal the end of the fiber-optic cable while preventing the fiber-optic cable from being released from the holding guides.

Advantageously the fiber-optic cable 40 withstands the temperature and pressure conditions in a borehole. The fiber-optic cable 40 can also be resistant to the various chemical compounds and elements in a borehole.

Advantageously, the fiber-optic cable 40 is suitable for a surface connection to a reflectometry distributed measurement device 110 which will be detailed below.

Figure 2:
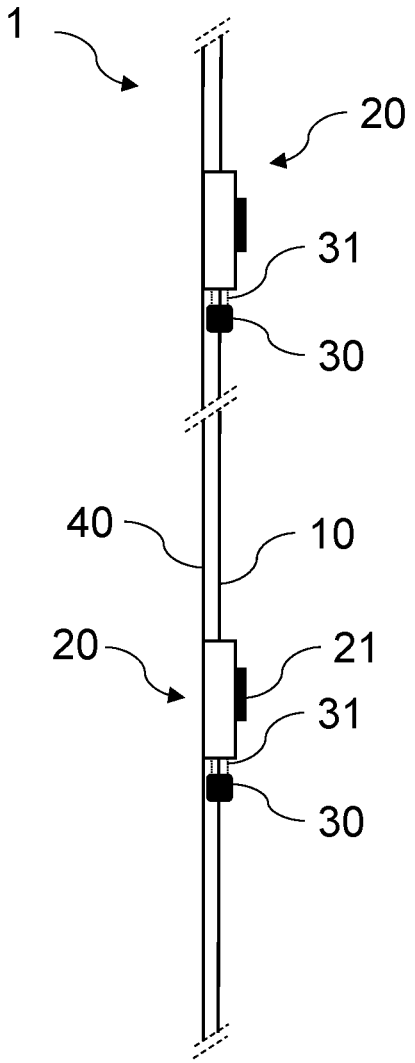
FIG. 2 represents a diagram of an embodiment of the maintenance device according to the invention.

In addition, as shown in FIG. 2, the maintenance device may include a safety cable 10.

Advantageously, the safety cable 10 has a tensile strength of more than 1 kN (kilonewton), preferably more than 2 kN, and even more preferably more than 20 kN. For example, the safety cable 10 can withstand at least a force that is equal to all the forces of the system with a predetermined safety coefficient. The safety cable 10 allows to withstand the entire weight of the device while taking into account a safety coefficient to take into account maneuvering hazards (traction if the device gets stuck in the borehole, shock if the device is suddenly released). This makes it possible to secure the maintenance device 1 both during its descent into the borehole and during its ascent. Thus, it is possible to exert a high tensile force on the safety cable 10 if the maintenance device 1 becomes jammed while being used in the borehole, without causing the safety cable 10 to break.

The tensile strength defines the limit at breakage. Thus, the maintenance device 1 has a breaking point of more than 1 kN, preferably 2 kN, and even more preferably more than 20 kN.

Preferably the breaking point is measured according to ISO6892.

To this end, the safety cable 10 can be made of stainless steel, composite material or carbon fibers, textile materials, or standard (non stainless) steel.

In addition, the surface of the safety cable 10 can be smooth or rough. Preferably the surface of the safety cable 10 is rough. This improves the attachment of the stops 30, detailed below.

Preferably, the safety cable 10 is light; that is to say its weight does not exceed 65 kg/km (kilogram per kilometer), preferably 30 kg/km. This facilitates its use and implementation.

The length of the safety cable 10 can be defined depending on the drilling to be carried out. For example, the deeper the borehole, the longer the safety cable 10. For example, the safety cable 10 may be longer than 2500 meters, preferably longer than 5000 meters. Preferably, the safety cable 10 has a length between 10 meters and 2500 meters, and even more preferably between 10 meters and 5000 meters.

As shown in FIG. 2, the maintenance device may include a plurality of stops 30. Each stop 30 is advantageously coupled, preferably attached, to the safety cable 10. In addition, they can be coupled to one of the holding guides 20 via a safety member 31 so as to limit the movement of said holding guide 20 with respect to the safety cable 10.

Figure 3:
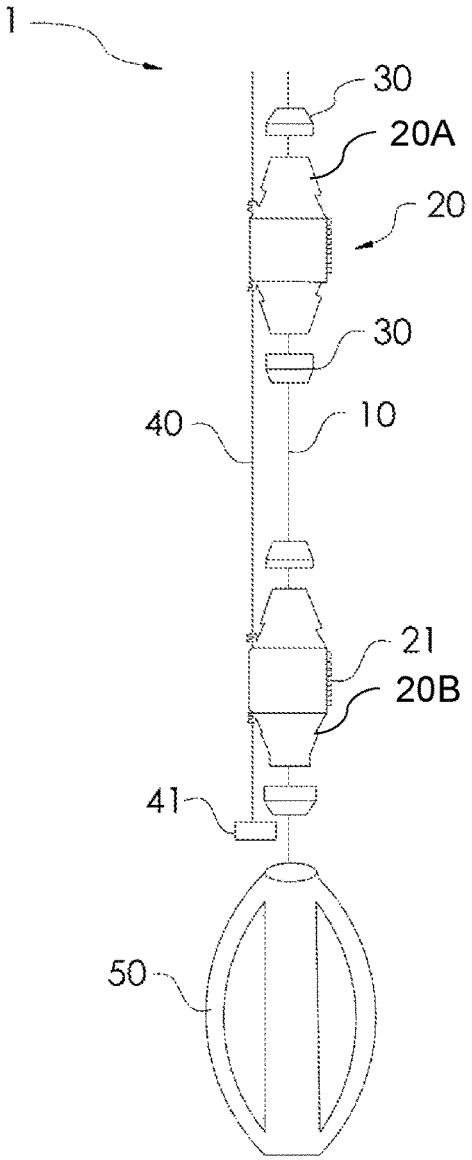
FIG. 3 represents a diagram of an embodiment of the maintenance device according to the invention.

Alternatively, as shown in FIG. 3, the maintenance device 1 may include a plurality of pairs of stops 30. Each stop 30 of a plurality of pairs of stops is then coupled, preferably attached, to the safety cable 10, on either side of a holding guide 20, respectively, so as to limit the movement of said holding guide.

In addition, it can be provided that each stop 30 has a passage, such as a bore, for example in its center, allowing the safety cable to pass through each stop.

The stops 30 are preferably of a double conical symmetrical shape, the base of the cone of which is facing each holding guide 20. In addition, the stops can be made of stainless steel, plastic, polymers, non-corrosive material, metal. Preferably, they are mainly made of aluminum to avoid corrosion. It also depends on the medium into which the device is introduced.

Each stop 30 can preferably have an outside diameter smaller than the outside diameter of the holding guides 20. Preferably, each stop 30 has an outside diameter greater than the outside diameter of the ends 20A, 20B of the holding guides 20. Alternatively, if each stop 30 has an outside diameter smaller than the outside diameter of the ends 20A, 20B of the holding guides 20, they have an outside diameter greater than the outside diameter of the projection 25, preferably of the conduit, of the holding guide 20. This prevents the stops from passing through the holding guides 20 and vice versa.

Each stop 30 coupled to the safety cable 10 and to one of the holding guides 20, can be coupled to the holding guide via one of its ends, preferably at the downstream end of the holding guide 20, namely the end 20B.

Alternatively, each stop 30 of the plurality of pairs of stops can be arranged on either side of a holding guide 20. One of the stops 30 of the pair of stops is arranged upstream of the holding guide 20 and the other stop 30 of the pair of stops is arranged downstream of said holding guide 20.

Each stop 30 may be a few centimeters (cm) upstream and/or downstream of each holding guide 20, preferably 10 cm away, more preferably at a distance favoring a maximum elongation of the order of 1% of the fiber-optic cable. Thus, the number of pairs of stops 30, or the number of stops 30, is preferably between 10 and 500. Preferably, the number of pairs of stops is equal to the number of guides.

In addition, each stop 30 can be attached to the safety cable 10. The attachment is preferably a compression attachment only onto the safety cable 10. The coupling of each stop to the holding guide 20 is preferably direct, removable, and extensible.

Each stop 30 allows to control the maximum elongation of the fiber-optic cable 40, which preferentially does not exceed 1% to 1.5%, in order to avoid breakage of the fiber-optic cable. Indeed, the fiber-optic cable 40 is generally removably attached to the holding guides 20, too important an elongation of the distance between two holding guides 20 could lead to the fiber-optic cable 40 breaking. Each stop 30 allows to limit the distance between two holding guides 20. Preferably, this distance is calculated to be not more than 1.5% of the maximum elongation undergone by the fiber-optic cable 40.

Figure 4:
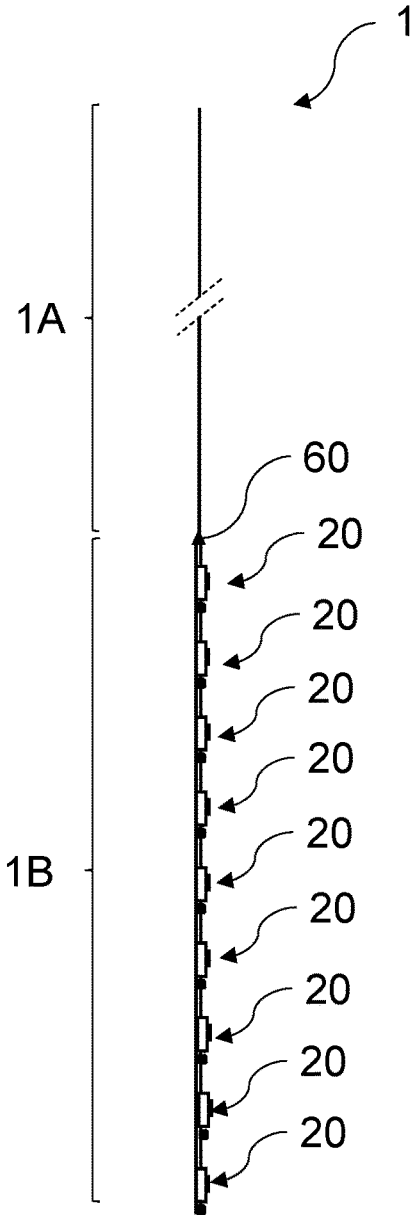
FIG. 4 represents a diagram of an embodiment of the maintenance device according to the invention.

According to an optional embodiment and as shown in FIG. 4, the maintenance device includes two parts. A first part 1A includes no holding guides while a second part 1B, also called the measurement section, includes the holding guides 20. The first part 1A, for example several kilometers long (for example at least 2 km), preferably consists of one or two cables including the optical fiber and steel or composite materials. The first part 1A can therefore include the fiber-optic cable 40 and the safety cable 10. Alternatively, it can be formed from a single reinforced fiber-optic cable. However, it does not include a maintenance guide. The second part includes the holding guides 20. In addition, in this case, the maintenance device may comprise a cable splicing system 60. Such a cable splicing system 60 allows the fiber-optic cable 40 to join the safety cable to form a single reinforced fiber-optic cable. Preferably, the fiber-optic cable joins the safety cable after the measurement section via the specific splicing system. In particular, the second part 1B may have an overlength in relation to the safety cable, after the splicing system 60.

Figure 5:
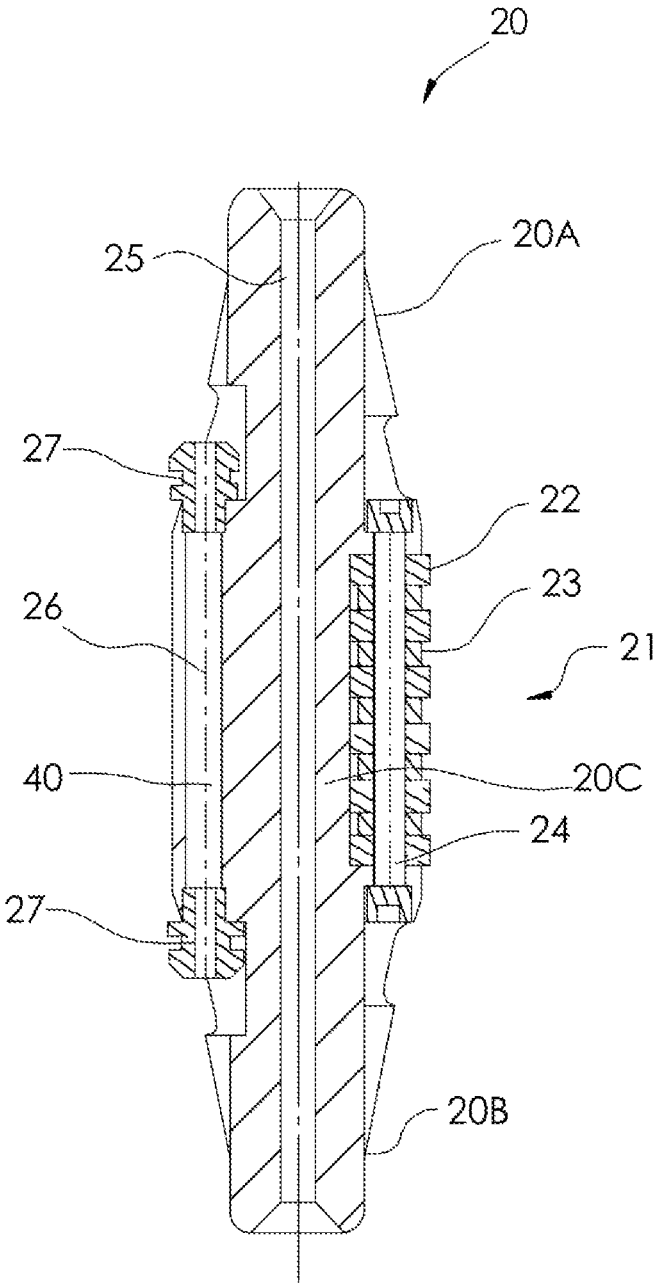
FIG. 5 represents a diagram of a holding guide according to the invention.

As shown in FIG. 5, the holding guides 20 are advantageously shaped longitudinally with two ends 20A, 20B and a central portion 20C. The holding guides 20 have at their ends 20A, 20B a diameter, preferably an outside diameter, of a smaller cross-section than the diameter, preferably the outside diameter, of the cross-section of the central portion 20C. This allows to facilitate the passage of the holding guides 20 in the tubular member and particularly of the different sections of the tubular member, when reducing the inside diameter of the tubular member.

Alternatively, the holding guides 20 can have a cylindrical, oblong, elongated, tapered, tubular, spherical, or spheroidal shape. Preferably, the holding guides 20 have a cylindrical shape.

Advantageously, the holding guides 20 can be essentially made of non-corrosive, stainless, or composite materials or of metal and preferably aluminum. This allows to prevent corrosion. It also depends on the medium into which the device is introduced.

In addition, each holding guide 20 can be arranged so as to accommodate the safety cable 10. Thus, each holding guide may comprise a conduit, cavity, gap, or housing to accommodate the safety cable 10. Preferably, each holding guide 20 comprises a conduit 25 formed in the holding guide 20 to accommodate the safety cable 10. This conduit 25 can protrude into the holding guide 20 along its entire length and preferably in its center. In other words, each holding guide 20 can be passed through by the safety cable 10, preferably in the longitudinal direction and in its center. In addition, each holding guide 20 can be arranged so as to allow a translational movement of the holding guides 20 with respect to the safety cable 10. This allows a degree of freedom between the safety cable 10 and the holding guide 20, resulting in the safety cable 10 sliding inside the holding guide 20.

Each holding guide 20 can be arranged so as to accommodate the fiber-optic cable 40. Thus, each holding guide may comprise a conduit, cavity, hole, gap, or housing to accommodate the fiber-optic cable 40. Preferably, each holding guide 20 may comprise a conduit 26. This conduit 26 can protrude into the holding guide 20 in the periphery of the center portion 20C of the holding guide 20. Preferably, this conduit 26 is diametrically opposed to the attachment means 21. In addition, this conduit 26 preferably has a longitudinal shape in the direction of the length of the holding guide 20. The fiber-optic cable 40 can enter the holding guide 20 through this conduit 26. In addition, this conduit 26 has an attachment means 27.

The attachment means 27 of a holding guide 20 can correspond to an attachment by compression, gluing, friction, or crimping. Preferably, the holding guides 20 comprise a means 27 for attaching by compression. This attachment means 27 can be arranged on the holding guide 20 and preferably on the surface opposite to that of the attachment means 21. Preferably, the attachment means 27 can be close to the housing 26 which accommodates the fiber-optic cable 40. Alternatively, this attachment means 27 can be arranged at each end of the housing 26 intended to accommodate the fiber-optic cable 40. This allows to increase the quality and reliability of the attachment. Each holding guide 20 can be attached to a fiber-optic cable 40. The attachment means 27 allows to attach the fiber-optic cable 40 to the holding guide 20. This attachment does not allow any degree of freedom between the holding guide 20 and the fiber-optic cable.

Thus, the number of holding guides 20 attached to the fiber-optic cable 40 can be between 2 and 500. The number of holding guides 20 through which the safety cable 10 passes can be between 2 and 500. For example, for a 5 km long fiber-optic cable, the number of holding guides is at least two, one at the bottom of the borehole and a second at the top of the borehole.

In addition, a maintenance device 1 according to the invention may comprise one or more ballasts 50. A ballast 50, within the meaning of the invention, can correspond to a weight, a clump weight, a drilling collar. Preferably, it is a clump weight with bow-springs. This allows the ballast 50 to be centered in the tubular member. Indeed, the ballast 50 is attached at one end of the safety cable 10 and/or the fiber-optic cable 40. This ballast 50 can also be assimilated to a rod, preferably made of metal, several meters long and centered inside the tubular member by the bow-springs.

The weight of the ballast 50 must be sufficient to cause the maintenance device 1 to be lowered completely into the tubular member. Typically, the sum of the ballast, guides, and stops must be greater than the friction force created by the attachment means, for example magnets.

The maintenance device 1 may additionally comprise pressure and/or temperature and/or acoustics measuring equipment. The coupling of the fiber-optic cable 40 to the inner walls of the tubular member thanks to the holding guides 20 makes it possible to carry out VSP ("Vertical Seismic Profile" in Anglo-Saxon terminology) seismic measurements thanks to the use of the optical fiber. Specific measuring equipment called DAS ("Distributed Acoustic Sensing" in English terminology) can also be added to the maintenance device 1. Pressure and also temperature measurements can be carried out using the optical fiber installed in the borehole. However, for the latter measurements, there is no advantage in having the fiber coupled to the tubular member by the holding guides 20. The maintenance device 1 may comprise Rayleigh backscattering measuring equipment for acoustic measurements. The maintenance device 1 may comprise Brillouin backscattering measuring equipment for temperature and/or deformation measurements. The maintenance device 1 may comprise Brillouin and/or Rayleigh backscattering measuring equipment for pressure measurements.

Thus, such a maintenance device 1 in addition to allowing the determination of the position of a blockage point 2 of a tubular member can also, by means of equipment for measuring pressure, and/or temperature and/or acoustics, allow for the analysis of a blockage point 2, its nature, its composition to be completed. This can also be used to confirm the blockage point 2 of the tubular member. In addition, this feature also makes it possible to carry out measurements independently of a blockage.

According to another aspect, the invention relates to a system 100 for determining the position of a blockage point 2 of a tubular member.

The occurrence of a blockage point 2 preventing the progress of drilling is unpredictable and often the consequence of external conditions such as a rock fall or a landslide. Nevertheless, it is also possible that the equipment could jam, deteriorate, or come apart, causing the drilling progress to stop. In addition, the position of the blockage point 2 may be random over the entire height of the borehole but may also be random depending on the length of the equipment (for example tubular member) inserted in the borehole. Such a system 100 according to the invention makes it possible to determine the position of a blockage point 2 simply and quickly. Indeed, this system 100 allows to carry out only one set of reflectometry measurements. In addition, the measurements are precise, accurate, and reliable.

Figure 6:
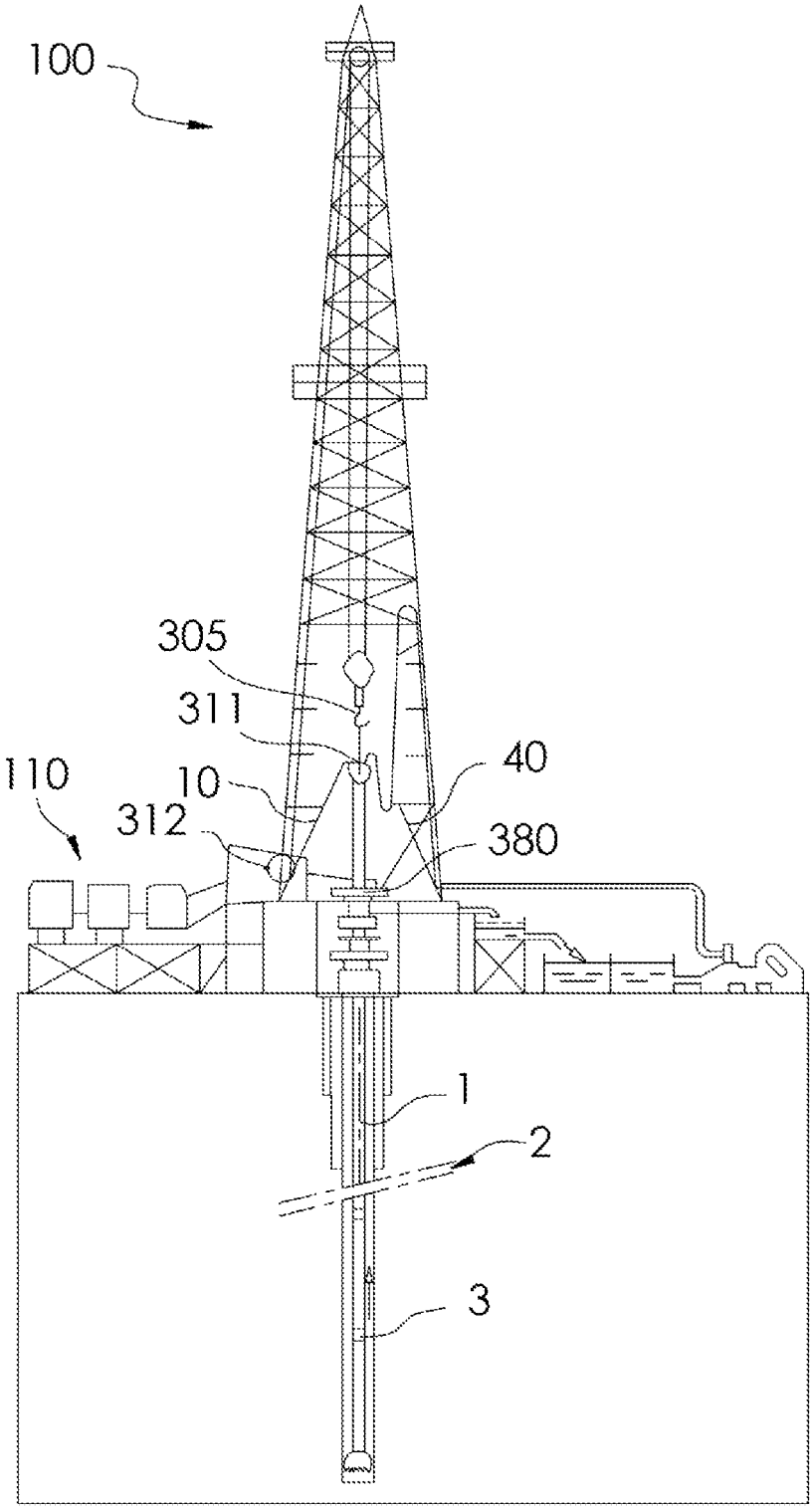
FIG. 6 represents a diagram of a system for determining the position of a blockage point of a tubular member according to the invention.

FIG. 6 shows an embodiment of such a system 100 according to the invention. This system includes in particular a maintenance device 1 according to the invention and a reflectometry distributed measurement device 110. The reflectometry distributed measurement device 110 is preferably connected to the maintenance device 1 and is configured to carry out a deformation measurement of the tubular member 3. Advantageously, the reflectometry distributed measurement device 110 is on the surface. This allows the measurement results to be retrieved directly at the surface.

The reflectometry distributed measurement device 110 allows to measure the deformations of the fiber-optic cable 40 over its entire length so as to determine where the tubular member 3 is jammed. The measurement carried out is preferably a B-OTDR (Brillouin Optical Time Domain Reflectometry in Anglo-Saxon terminology or Réflectométrie optique temporelle)-type measurement. Thus, the reflectometry distributed measurement device 110 is preferably of the B-OTDR type. This type of device 110 is also called a Brillouin backscattering distributed optical fiber sensor.

Alternatively, other measuring devices are possible such as a Bragg grating sensor, a Rayleigh scattering sensor (phase-OTDR), OFDR (Optical Frequency Domain Reflectometry).

Such measuring devices are used for permanently checking the integrity and safety of systems and structures in the oil industry. Briefly, a light signal is injected into an optical fiber and the light signal backscattered by the optical fiber is then used to deduce the structural state of the tubular member. Advantageously these Brillouin backscattering distributed measurement optoelectronic devices measure in real time at any point of the fiber-optic cable 40.

In particular, the reflectometry distributed measurement device 110 may include a light source emitting a continuous light signal. This light source is advantageously embodied by a laser, preferably a DFB (from the English acronym "Distributed Feedback") laser, using a Bragg grating. The emission wavelength λ0 is preferably equal to 1550 nm, at the corresponding frequency v0. The line of the emitted light wave is centered on the emission wavelength λ0 and its width is at most 1 MHz (megahertz).

This reflectometry distributed measurement device 110 includes at least one acousto-optic modulator. It may also include one or more amplifiers if necessary, to provide gain. The acousto-optic modulator transforms the continuous signal with a frequency v0 into a pulsed signal with a frequency vp=v0+vA, where vA is the frequency specific to the modulator, and is generally greater than or equal to 100 and lower than or equal to 500 MHz, preferably of the order of 200 MHz.

The local oscillator advantageously comprises a circulator which directs the incident continuous light signal, at the frequency v0, from the laser, into a reference optical fiber. This reference optical fiber is advantageously identical to the optical fiber under test. The reference fiber is not subject to any deformation. It is placed at a reference temperature, generally between 18 and 25° C. (Celsius), preferably at a temperature of the order of 20° C. This reference fiber also allows to emit a Brillouin backscattering signal in response to the continuous signal emanating from the light source, so that the local oscillator allows to transform the incident frequency v0 into a frequency vOL=v0+vBref, where vBref represents the Brillouin frequency of the reference optical fiber, and which is in the same frequency range as the frequency vBz from the signal backscattered by the optical fiber under test. The Brillouin frequency of the reference optical fiber is therefore in a frequency range around 11 GHz, generally between 10.5 GHz and 11.5 GHz. The circulator of the local oscillator then sends the backscattered signal to the coupler to mix it with the backscattered signal from the optical fiber under test.

Alternatively, Brillouin and/or Rayleigh backscattering measuring equipment comprises a light source emitting a continuous light signal. This light source is advantageously embodied by a laser, preferably a DFB (from the English acronym "Distributed Feedback") laser, using a Bragg grating. The emission wavelength $\lambda_0$ is preferably equal or substantially equal to 1550 nm, at the corresponding frequency $v_0$. The line of the emitted light wave is centered on the emission wavelength $\lambda_0$ and its width is at most 1 MHz.

Advantageously, the light source is frequency tunable and its frequency can be continuously varied at a speed of at least 1 GHz/sec (gigahertz per second) over an interval of at least 125 GHz. More preferably, the light source is capable of emitting a continuous laser radiation at an optical frequency $v_0$ that can be varied, over the duration of all acquisitions, according to a continuous ramp of at least 250 GHz. This frequency modulation must be continuous and not by frequency steps and thus allows to reduce the effects of intra-pulse interference and therefore noise. This feature is particularly important when monitoring Rayleigh backscattering is desired.

The light source, for example a laser, emits a moderately powerful continuous light signal, typically of the order of 20 mW, in an optical fiber connecting it to a first coupler or to a third coupler.

The first coupler, receiving the light signal via light source or via the first arm of the third coupler, is capable of dividing said continuous light signal into two signals of identical frequency distributed into two arms.

The first arm connects the first coupler to a reference fiber block including a reference fiber, said reference fiber block being capable of emitting another light signal with a frequency $v_0-v_{bref}$, where $v_{bref}$ is the Brillouin frequency of the reference fiber, intended to be transmitted to the modulator or to be mixed with said initial signal by a fourth coupler. Thus, the reference block allows the information to be sent back in a lower frequency band, thus improving the performance of the device. The reference optical fiber is stored without deformation and at a reference temperature. The second arm connects the first coupler to a second coupler located downstream of the modulator and is capable of transmitting to the second coupler a continuous light signal at a frequency $v_0$, thus constituting a local oscillator. More particularly, the second arm connects the first coupler to a second coupler located upstream of the photodetection module and preferably it is positioned just before said photodetection module.

The first coupler is capable of directing sufficient energy of the light signal to the first arm so as to exceed the Stimulated Brillouin Scattering (Stimulated Brillouin Scattering) threshold and thus, in the reference fiber, so that the backscattered wave is shifted by a frequency $-v_{bref}$ with respect to the optical wave. Advantageously, the first coupler is capable of directing the majority of the energy of the light signal to the first arm. Preferably, the first coupler is capable of directing more than 70%, more preferably more than 80%, even more preferably substantially 90% of the energy of the light signal to the first arm.

The reference block advantageously comprises a circulator which directs the incident continuous light signal, at the frequency $v_0$, from the first coupler, into a reference optical fiber. This reference optical fiber may be identical to the optical fiber to be tested. Advantageously, the reference fiber is not subject to any deformation. It is placed at a reference temperature, generally between 18 and 25° C., preferably at a temperature of the order of 20° C. This reference fiber also allows to emit a Brillouin backscattering signal in response to the continuous signal emanating from the light source, so that the reference block allows to transform the incident frequency $v_0$ into a frequency $v_{br}=v_0-v_{Bref}$, where $v_{Bref}$ represents the Brillouin frequency of the reference optical fiber, and which is in the same frequency range as the frequency $v_{bAS}$ from the signal backscattered by the optical fiber to be tested. In addition, advantageously, the reference optical fiber of the reference fiber block has a Brillouin frequency different from that of the optical fiber to be tested. For example, the reference optical fiber has a Brillouin frequency shift of at least 200 MHz, preferably of at least 300 MHz compared to the Brillouin response of the fiber to be measured. Preferably, the Brillouin frequency of the reference optical fiber has a frequency difference with the Brillouin frequency of the optical fiber to be tested, between 300 MHz and 1 GHz. Thus, this avoids any spectral overlap of the Rayleigh and Brillouin spectra while limiting the requirements for subsequent signal processing. Indeed, the photodetection module located at the end of the optoelectronic assembly receives a signal from the Rayleigh backscattering which is modulated at the frequency of the acousto-optic modulator $\nu_A$ (for example 200 MHz) and the Brillouin backscattering modulated at the frequency ($\nu_{bAS}-\nu_{bref}+\nu_A$) without there being any overlap between the two spectra.

Such an architecture allows the reference fiber to be placed on the same optical arm as the optical fiber to be tested. This has the advantage of improving measurement quality by having a signal in the local oscillator directly from the source and therefore without low frequency interference. It is therefore not necessary to use a low frequency electrical filter at the output of the photodetection module. This configuration also allows to measure the anti-Stokes line of the Brillouin backscattering and, unlike prior art devices, to access measurements close to the DC (for example around 100 MHz) in the electrical domain where it was not previously possible to take reliable measurements.

The third coupler allows to divide the incident light signal emitted by the light source into two signals of identical frequency distributed into two arms of the device.

The first arm connects the third coupler to the first coupler and the first arm is capable of transmitting to the first coupler a continuous light signal at a frequency $\nu_0$. The second arm connects the third coupler to a fourth coupler located upstream of the modulator and this second arm is capable of transmitting to the fourth coupler an initial signal at a frequency $\nu_0$.

Advantageously, the third coupler is capable of directing the majority of the energy of the light signal to the first arm. Preferably, the third coupler is capable of directing more than 70%, more preferably more than 80%, even more preferably substantially 90% of the energy of the light signal to the first arm.

As specified, the fourth coupler is capable of mixing the initial signal $\nu_0$ from the second arm of the third coupler with the light signal with a frequency $\nu_0-\nu_{bref}$ from the reference fiber and injecting them into the modulator. The signals from the reference optical fiber are therefore recombined with the initial signal $\nu_0$ in the fourth coupler. At the output of the fourth coupler, a signal containing a signal at the frequency $\nu_0-\nu_{bref}$ from the reference optical fiber and a signal at the same frequency as the initial signal $\nu_0$, is obtained.

The modulator is capable of imposing a frequency shift of at least 100 MHz on the continuous signal and transforming it into a pulse signal to be injected into an optical fiber to be tested. Preferably, the modulator is an acousto-optic modulator. The modulator may be associated with one or more amplifiers if necessary, to provide gain. The signal from the modulator has at least two components,

- a continuous component with a frequency $\nu_0-\nu_{bref}$, transformed into an impulse component with a frequency $\nu_{p1}=\nu_0-\nu_{bref}+\nu_A$, and
- a continuous component with a frequency $\nu_0$, transformed into an impulse component with a frequency $\nu_{p2}=\nu_0+\nu_A$.

The modulator is capable of generating a pulse signal having a frequency shifted from the frequency of the continuous light signal. The frequency shift $\nu_A$ applied to said shifted frequency may be greater than or equal to 100 MHz. The frequency $\nu_A$ is the natural frequency of the modulator and is generally greater than or equal to 100 MHz and less than or equal to 1 GHz, preferably substantially equal to 200 MHz. The time width of the pulse thus generated may for example be between 10 ns and 500 ns, preferably it is substantially equal to 20 ns. The pulsed signal is then directed to a circulator which then injects it into the optical fiber to be tested, on which the distributed measurement must be carried out. When the pulse signal passes, the optical fiber transmits in the opposite direction a signal by spontaneous Brillouin backscattering at the frequency $\nu_{F1}=\nu_0-\nu_{bref}+\nu_A+\nu_{bAS(z)}$; and $\nu_0-\nu_{bref}+\nu_A-\nu_{bS(z)}$ where $\nu_{bAS}$ is the anti-Stokes Brillouin frequency to be measured at any point with a coordinate z along the optical fiber. $\nu_{bS(z)}$ is the Stokes Brillouin frequency. The optical fiber also transmits in the opposite direction a signal by Rayleigh backscattering at the frequency $\nu_{F2}=\nu_0+\nu_A$.

These backscattered signals are directed, by the circulator, to the second coupler where they are recombined with a signal $\nu_0$ from the local oscillator. In addition, advantageously, the second arm may include a polarization jammer arranged in that case upstream of the inputs of a second coupler. This allows to reduce the interference effects due to the polarization between the local oscillator arm and the measuring arm, also called the "pump" arm, and located between the circulator and a second coupler.

The second coupler is capable of coupling the signal from the local oscillator to the backscattering signal from the optical fiber to be tested before transmitting it to the photodetection module. The second coupler may be combined with optional modules such as a separation (beam splitter polarization) module or a polarization hybridization module. The backscattering signal may be modulated at least at a Brillouin frequency $\nu_{rB}$ equal to $\nu_0-\nu_{bref}+\nu_A+\nu_{bAS}$, where $\nu_{bAS}$ is the anti-Stokes Brillouin backscattering frequency measurable at any point z of the optical fiber to be tested. This gives the user the possibility to measure the Brillouin backscattering anti-Stokes line while taking advantage of a local oscillator without interference at low frequencies and thus improves measurement quality.

The backscattering signal from the optical fiber to be tested may also be modulated at a Rayleigh frequency $\nu_{rR}$ equal to $\nu_0+\nu_A$. This is possible when the device according to the invention includes the third coupler and fourth coupler. This second coupler then allows the Rayleigh backscattering created in the optical fiber to be tested to couple with the frequency of the local oscillator. Thus, the device according to the invention also allows to measure the Rayleigh backscattering spectrum. Preferably, the backscattering signal is modulated at a frequency $\nu_{rR}$ equal to $\nu_0+\nu_A$ and at a frequency $\nu_{rB}$ equal to $\nu_0-\nu_{bref}+\nu_A+\nu_{bAS}$.

These one or more beats are electronically detectable using a photodetection module positioned downstream of the second coupler and it is capable of transmitting the received backscattering signal to a processing module. The photodetection module includes at least one photodetector. Advantageously, the photodetection module has a bandwidth of at least 800 MHz, preferably at least 1 GHz. The photodetection module located at the end of the optoelectronic assembly is capable of receiving a signal from the Rayleigh backscattering modulated at the frequency of the acousto-optic modulator $\nu_A$ and the Brillouin backscattering modulated at the frequency ($\nu_{bAS}-\nu_{bref}+\nu_A$). Under these conditions, at the output of the photodetection module, the electrical signal obtained corresponding to the beats detected at the frequency $\nu_{Batt1}=\nu_A+(\nu_{bAS}-\nu_{Bref})$ corresponding to the Brillouin backscattering and at the frequency $\nu_{Batt2}=\nu_A$ corresponding to the Rayleigh backscattering. Thanks to the architecture of the device according to the invention, these beats were obtained from a single measurement and a single optical fiber to be tested. In addition, these beats have a frequency lower than the incident signals because the frequency $\nu_0$ from the light source is eliminated. Typically, a first beat corresponding to $_{Batt1}=\nu_A+(\nu_{bAS}-\nu_{Bref})$ has a frequency greater than 200 MHz, and preferably around 500 MHz, and a second beat corresponding to $\nu_{Batt2}=\nu_A$ has a frequency for example substantially equal to 200 MHz, corresponding to the magnitude of the natural frequency of the modulator. Indeed, $\nu_A-(\nu_{bS}+\nu_{Bref})$ is at about 20 GHz and therefore out of band. The optical configuration therefore allows to increase the efficiency of the photodetection module by limiting the bandwidth to less than 2 GHz instead of 11 GHz, preferably to less than 1 GHz, for example between 400 MHz and 1 GHz.

Advantageously, the device according to the invention may not comprise a low frequency electrical filter at the output of the photodetection module. Indeed, as previously specified, positioning the reference fiber on the same optical arm as the optical fiber to be tested allows to improve measurement quality by having a signal in the local oscillator without low frequency interference. By suppressing these low-frequency interferences, this configuration also gives access to information that cannot be used with the configurations of the prior art (for example <100 MHz).

The one or more beat signals obtained can then be digitized, by means of an analog-to-digital converter module. They are then processed by a digital processing module. Advantageously, the analog-to-digital converter module has a bandwidth of at least 800 MHz, preferably at least 1 GHz, and a sampling rate of at least 1.6 Gech/s, preferably at least 2 Gech/s.

The processing module is advantageously configured to link said anti-Stokes Brillouin frequency $\nu_{BAS}$ to a temperature value and/or a deformation value at any point "z" of said optical fiber to be tested. Thus, it is capable of separating the temperature measurement and the deformation measurement in order to obtain, from a single measurement, distinct temperature and deformation values. The latter may include an acquisition board for acquiring the signal generated by the photodetection module, and therefore having a bandwidth and a sampling frequency able to analyze a signal corresponding to: $\nu_A+\nu_{bAS}-\nu_{bref}$. Thus, advantageously, the processing module is capable of measuring a signal with a bandwidth of at least 800 MHz, preferably at least 1 GHz, and a sampling rate of at least 1.6 Gech/s, preferably at least 2 Gech/s, in order to detect both spectra simultaneously (Brillouin spectrum and Rayleigh spectrum). In addition, it is advantageous to use an acquisition board with a high resolution, such as a resolution of 10 bits or more. This allows, considering the small variations in the intensity of the Brillouin backscattered spectrum as a function of the temperature, to achieve an accuracy of around 1° C. The analog-to-digital converter module and the processing module are presented separately but can be integrated into a single assembly positioned directly after the photodetection module.

The processing module is capable of slicing the digitized signal into a plurality of slices (T1 . . . Ti . . . TN) by applying a sliding time window of the rectangular, or Hamming, or Hann, or Blackman-Harris window type, each slice having a width equal to the time width of a pulse of the pulse signal injected into the optical fiber to be tested, the width of each slice further being centered around a date t corresponding to a point of coordinate z of said optical fiber to be tested.

In addition, the digital processing module advantageously uses a discrete (preferably fast) Fourier transform algorithm, for example by means of a logic integrated circuit known by the English acronym FPGA (for "Field-Programmable Gate Array"). It thus allows to directly compute the Brillouin frequency, the total intensity of the Brillouin backscattering, and/or the total intensity of the Rayleigh backscattering, at any point with a coordinate "z" of the optical fiber under test. The digital processing module further allows to average the spectra obtained in the frequency domain, for each point z of said fiber, upon completion of the application of the discrete (preferably fast) Fourier transform algorithm, in order to determine the distributed measurement of the frequency variation along said optical fiber under test.

According to another aspect, the invention relates to a method 200 for determining the position of a blockage point 2 of a tubular member 3 by means of a maintenance device 1 comprising a fiber-optic cable 40 and a plurality of holding guides 20. Each holding guide 20 can be attached to the fiber-optic cable 40 and include a means 21 for attaching to the tubular member 3. In addition, the maintenance device 1 is preferably inserted into the tubular member 3 and the holding guides 20 are attached to the tubular member 3 by means of the attachment means 21.

Preferably, the method 200 for determining the position of a blockage point 2 of a tubular member 3 via a maintenance device 1 comprises using a safety cable 10, a plurality of holding guides 20, a plurality of pairs of stops 30 or a plurality of stops 30 and a fiber-optic cable 40.

Figure 7:
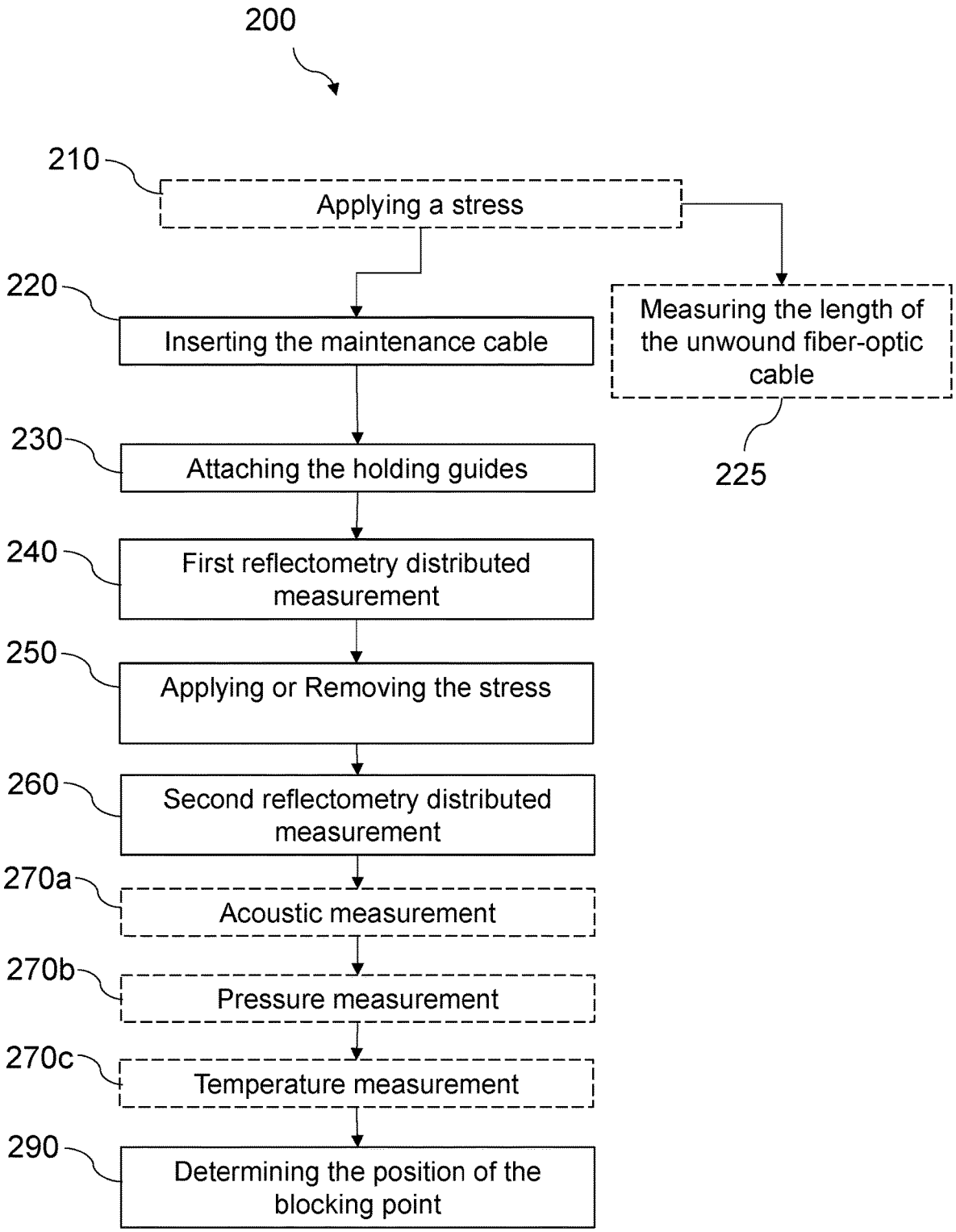
FIG. 7 represents a diagram of an embodiment of the method for determining the position of a blockage point according to the invention.

Such a method, shown in FIG. 7, according to the invention, makes it possible to check in a single set of measurements a hundred meters of the tubular member 3. This saves a considerable amount of time. In addition, the measurements are accurate, reliable, and precise. The method 200 according to the invention also allow to save a considerable amount of time and reduce the use of expensive and specific equipment. In addition, the method is safe as it does not require the use of an active sensor.

A method 200 for determining the position of a blockage point 2 comprises

- a step 240 of a first reflectometry distributed measurement,
- a step 250 of applying a stress to the tubular member 3 or of removing a stress applied to the tubular member 3 prior to the step 240 of the first reflectometry distributed measurement,
- a step 260 of a second reflectometry distributed measurement, and
- a step 290 of determining the position of the blockage point 2 of the tubular member 3 by comparing the first and second reflectometry measurements.

In addition, a method 200 according to the invention may comprise a step 210 of applying stress, a step 220 of inserting the maintenance device into the tubular member and/or a step 230 for attaching to the holding guides to the tubular member 3. Furthermore, a method 200 according to the invention does not require the repetition of a plurality of measurements but allows the position of a blockage point to be identified over several tens of meters in a single measurement.

The step 210 of applying stress to the tubular member can be performed up to the depth where the tubular member 3 is jammed. Stress can be applied by traction or by any means that allows uniform deformation over the entire length of the tubular member 3. This stress on the tubular member is, for example, maintained during the entire step 220 of inserting the maintenance device into the tubular member. Thus, applying stress can be implemented before the step 220 of inserting the maintenance device 1 into the tubular member as shown in FIG. 7 or after inserting the fiber-optic cable and before attaching to the holding guides (not shown).

The step 220 of inserting the maintenance device 1 into the tubular member 3 may comprise inserting the safety cable 10 and the fiber-optic cable 40 into the tubular member 3 in parallel. In addition, this allows several hundred meters to be covered in a single insertion step 220.

In the context of a maintenance device 1 including two parts 1A and 1B, as shown in FIG. 4, only one cable can be unwound at the surface.

Such a method may further comprise, a step 225 of measuring the length of the unwound fiber-optic cable 40. This step is preferably carried out in parallel with the step 220 of inserting the maintenance device 1 into the tubular member 3. In addition, the length of unwound fiber-optic cable 40 can be measured continuously and constantly. Alternatively, the length of the unwound safety cable 10 can also be measured parallel to the length of the unwound fiber-optic cable 40. This avoids any overlength of one cable in relation to the other. Thus, it eliminates the risk of one of the cables breaking.

In the case where only one cable is unwound at the surface, preferably in the case of a cable shown in FIG. 4, there is only one measurement of the length of the unwound cable. Indeed, the fiber-optic and safety cables meet, so only one cable is present at the surface.

The step 230 of attaching the holding guides 20 to the tubular member 3 allows the fiber-optic cable 40 to be attached to the inner wall of the tubular member 3. This allows to improve the precision, reliability, and accuracy of the measurements. In addition, during this step, the weight, in particular the one or more ballasts 50, may be neutralized. To do this, a pulling force can be exerted on the safety cable 10 so as to raise the one or more ballasts 50 when all holding guides 20 are attached. This allows to prevent one of the stops 30 from coming into contact with the corresponding holding guide 20. In addition, it allows the tension forces of the fiber-optic cable 40 and the friction forces created by the holding guides 20 to cancel each other out.

The step 240 of a first reflectometry distributed measurement of the optical fiber is preferably a B-OTDR-type measurement. Alternatively, the measurement can be of the FDR (Frequency Reflectometry) type. More particularly, the measurement carried out can be of the calibration type which is carried out once the maintenance device 1 is lowered and before relaxation or creation of stress on the tubular member 3. The measurement step may include calculating the Brillouin backscattering in the optical fiber by means of a reflectometry distributed measurement device 110. The step 240 of the first distributed measurement of the deformation of the optical fiber is preferably carried out during stress.

During reflectometry distributed measurements, the laser 1 of the reflectometry distributed measurement device 110 emits a pulse signal with a frequency vp=v0+vA. The time width of the pulse thus generated is for example between 10 ns and 200 ns, preferably it is 20 ns. The pulsed signal is then directed to a circulator which then injects it into the optical fiber, on which the distributed measurement must be carried out.

When the pulsed signal passes, the optical fiber emits in the opposite direction a spontaneous Brillouin backscattering signal at the frequency vF=v0+vA+vBz; wherein vBz is the Brillouin frequency to be measured at any point with a coordinate z along the optical fiber. This backscattered signal is directed by the circulator towards the coupler where it is recombined with a signal from the local oscillator forming the second arm of the device.

The signals from the optical fiber under test and from the reference optical fiber are thus recombined in the coupler. At the output of the coupler, a signal is obtained, which contains a beat between the signal from the optical fiber under test and from the reference optical fiber of the local oscillator. This beat, of a lower frequency, is detectable electronically thanks to the use of a photodetector, with a bandwidth of less than 1 GHz, preferably of 500 MHz. At the output of the photodetector, an electrical signal corresponding to the beat detected at the frequency vBatt=vA+(vBz−vBref) is thus obtained. The beat has a frequency lower than the incident signals because the frequency v0 from the light source is eliminated. Typically, the beat has a frequency lower than 500 MHz, and preferably around 200 MHz, corresponding to the order of magnitude of the frequency specific to the acousto-optical modulator.

The beat signal obtained is then digitized, by means of an analog-to-digital converter module. It is then processed by a digital processing module.

The advantageous configuration of the device 110 according to the invention allows to eliminate all the necessary preliminary checks when using a Brillouin ring laser in order to avoid disturbances on the signal (by laser cavity instability). It also allows to reduce the frequency to be detected by the photodetector to less than 500 MHz, and more particularly in a frequency band centered around 200 MHz. The optical configuration therefore allows to increase the efficiency of the photodetector by limiting the bandwidth to less than 1 GHz instead of 11 GHz, preferably to 500 MHz.

As for the digital processing module, it advantageously uses a fast Fourier transform FFT algorithm, for example by means of a logic integrated circuit known by the English acronym FPGA (for "Field-Programmable Gate Array"). It thus allows to directly calculate the Brillouin frequency at any point with a coordinate z of the optical fiber. The digital processing module further allows to average the spectra obtained in the frequency domain, for each point z of said fiber, upon completion of the application of the fast Fourier transform FFT algorithm, in order to determine the distributed measurement of the frequency variation along said optical fiber under test.

When the measurement of the optical fiber deformation during stress is complete, the method may comprise a step 250 of applying a stress or removing the stress applied to the tubular member 3. For example, the deformation that was applied is lifted, the tubular member 3 is then in a relaxed state.

The method may comprise a 260 step of a second reflectometry distributed measurement. Preferably, this second measurement is carried out after removal of the stress. The deformation measurement step 260 may include calculating the Brillouin backscattering in the optical fiber by means of a deformation distributed measurement device 110. Preferably, it is a B-OTDR-type measurement. This allows the compression or deformation of the fiber-optic cable 40 to be measured.

The method may comprise a step 290 of determining the position of the blockage point 2 of the tubular member 3 by comparing the first and second reflectometry distributed measurements. This allows the deformation of the optical fiber to be determined during the stress and after the stress has been removed. The comparison of these two measurements gives the position of the change of state of the tubular member. Typically, on a deformation Brillouin relative measurement, when the difference between the measurement before relaxation of the tubular member and after relaxation is zero, then the tubular member is jammed. When the deformation relative measurement is proportional to the force exerted on the surface of the tubular member 3, then the latter is not jammed. Thus, the method includes only one set of measurements. In addition, the method allows to save time while being passive and safer.

Figure 8A:
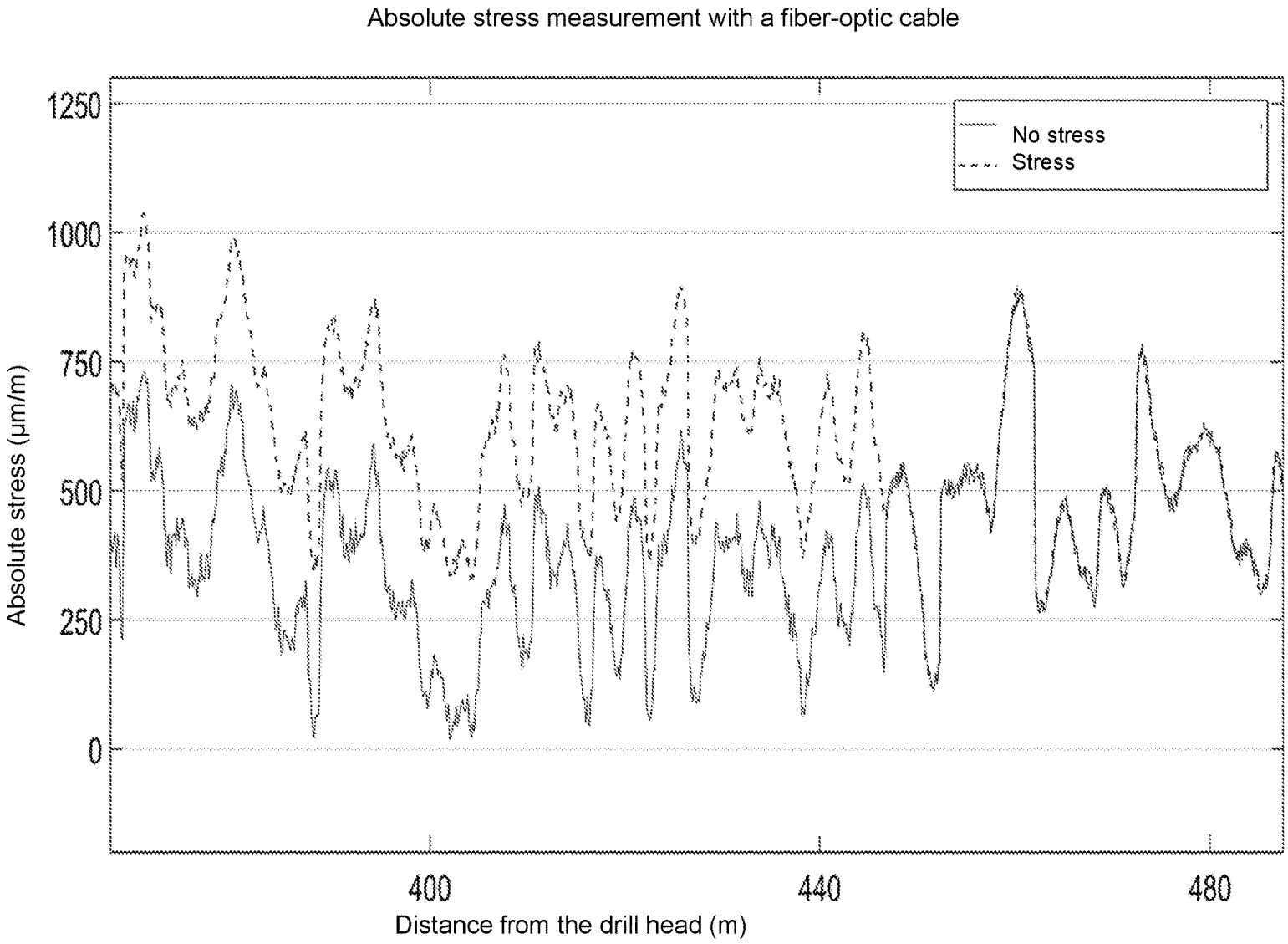
FIG. 8A represents a graph of a deformation absolute measurement by an optical fiber.
Figure 8B:
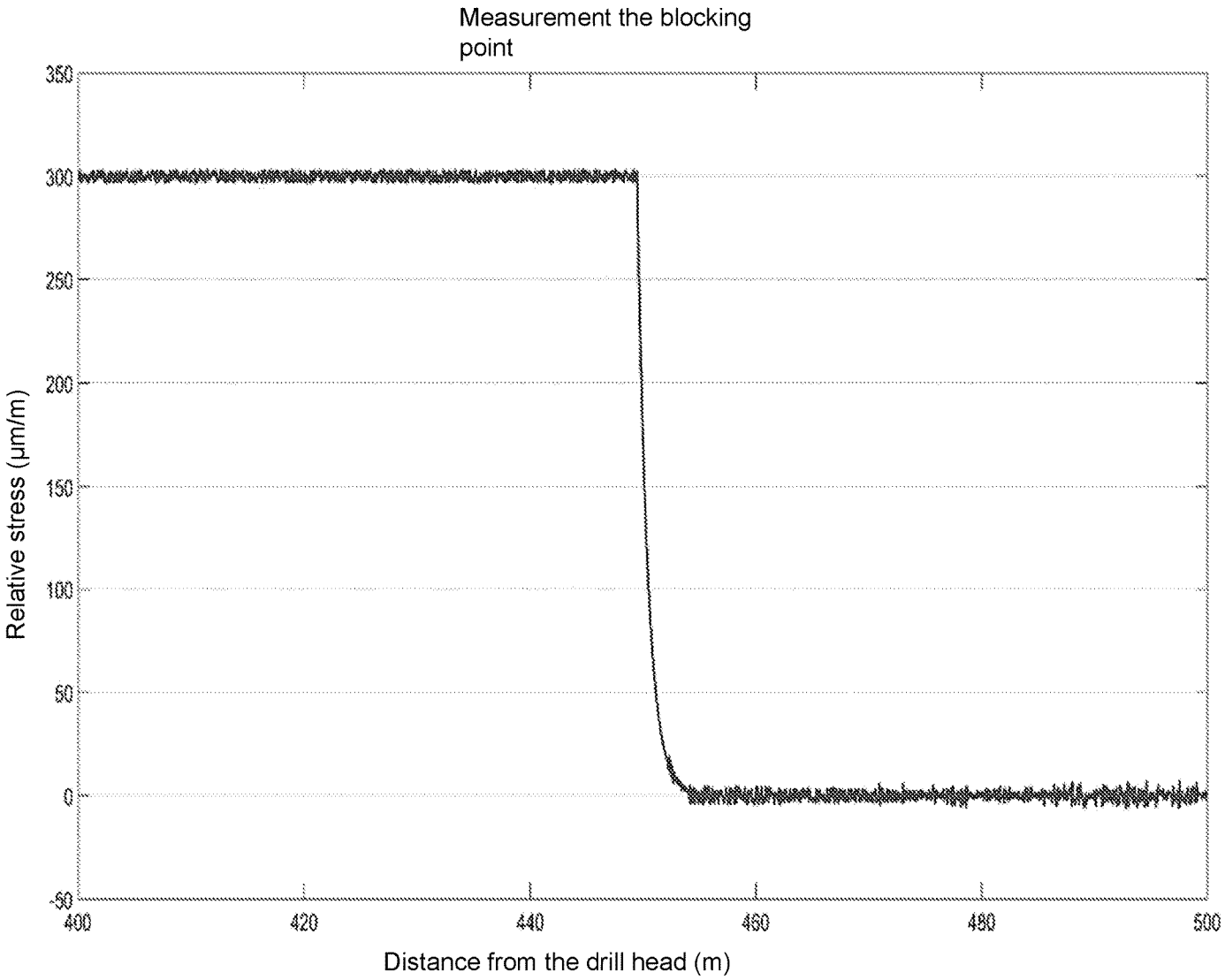
FIG. 8B represents a graph of a deformation relative measurement by an optical fiber.

Two examples of the results of the determination of the position of the blockage point 2 are shown in FIGS. 8A and 8B.

FIG. 8A shows the deformation distributed measurements by optical fiber. A typical measurement of absolute deformation is carried out by a fiber-optic measuring device 110 on the fiber-optic cable 40 present in the invention. The fiber-optic cable is placed at a depth of about 400 meters in the tubular member 3. Only one set of measurements is carried out, one measurement when the stress on the tubular member is present and one measurement when the stress on the tubular member is removed. In FIG. 8A, the results have different values up to a distance of 450 meters. After this distance, the two measurements are identical. The measurement carried out leads to the conclusion that the tubular member is jammed in the borehole from a depth of 450 meters. The measurement is precise to the meter, reliable, and accurate. Moreover, it is fast and simple.

FIG. 8B shows the deformation distributed measurements by optical fiber. A relative deformation measurement is carried out by an optical fiber measuring device 110 on the fiber-optic cable 40 according to the invention. The fiber-optic cable is placed at a depth of about 400 meters in the tubular member 3. One measurement is carried out when the stress on the tubular member is present and one measurement is carried out when the stress on the tubular member is removed. In FIG. 8B, the sudden plateau change indicates the depth at which the tubular member is jammed. The measurement is also precise, accurate, and reliable. It is also simple and fast.

The method may further comprise an acoustic measurement step 270*a*. This allows to complete the method for determining the blockage point 2 of a tubular member 3. Indeed, this can provide additional information, such as the nature of the blockage, for example a torsional or tensile blockage. To this end, the method may comprise Rayleigh backscattering equipment for acoustic measurements, VSP (Vertical Seismic Profiling) equipment, and a device for generating acoustic vibration at the desired depth.

The method may further comprise a pressure measurement step 270*b*. The method may further comprise a temperature measurement step 270*c*. This can provide additional information, but also monitoring of the blockage point 2 or the tubular member 3. To this end, the method may comprise Brillouin backscattering measuring equipment for temperature and/or deformation measurements. The method may also comprise Brillouin and/or Rayleigh backscattering measuring equipment for pressure measurements.

According to another aspect, the invention relates to a system 300 for assembling a maintenance device 1 for determining the position of a blockage point 2 of a tubular member 3.

Figure 9:
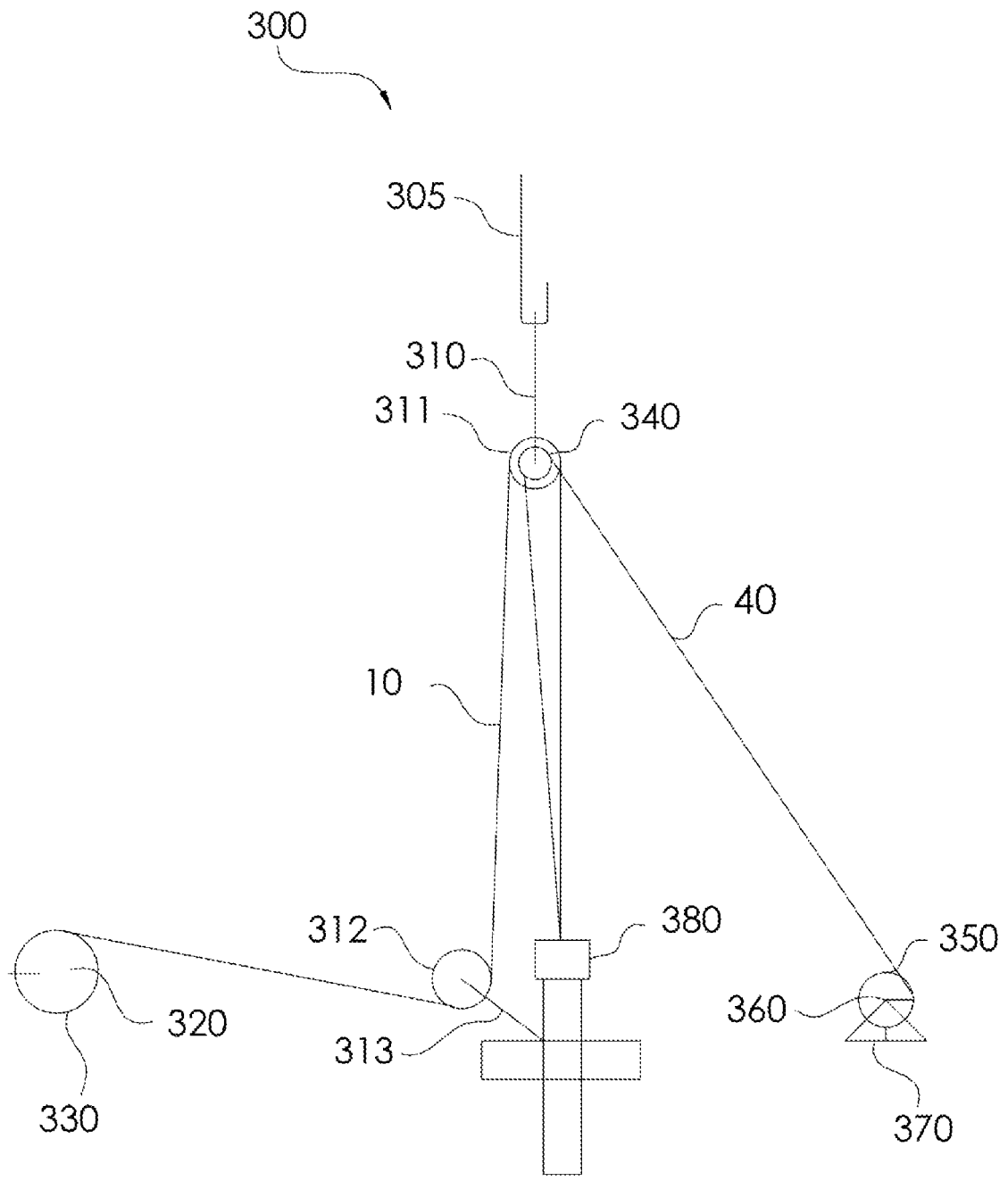
FIG. 9 represents a diagram of an embodiment of the assembly system according to the invention.

The system, shown in FIG. 9, may comprise a lifting crane 305. This lifting crane allows the safety cable 10 and the fiber-optic cable 40 of the maintenance device 1 to be lifted by means of pulleys.

The system may comprise at least one pulley 311,312 for the safety cable 10, intended to transmit movement to the safety cable 10. A first pulley 311 coupled to the lifting crane 305, allows to transmit the lifting movement of the lifting crane 305 to the safety cable 10. Preferably, the first pulley 311 is coupled to the lifting crane 305 by means of a sling 310. A second pulley 312, preferably on the surface at ground level, allows the safety cable 10 to be unwound as the lifting crane 305 moves up or down. This second pulley 312 is preferably attached to the drill head by a sling 313. Thus, the first 311 and the second 312 pulley allow the movements of the lifting crane 305 to be transmitted to the safety cable 10. The movements of the lifting crane 305 actuate the rotation of the pulleys 311,312 which then allow for the first pulley 311 to transmit the lifting movement, and for the second pulley 312 to transmit the lifting movement resulting in unwinding the safety cable 10.

The safety cable 10 can be unwound from a reel 330, coupled to a lifting device 320. The lifting device 320 is preferably a winch. The winch can be motorized or not. It allows to control the winding and unwinding of the safety cable 10.

The system can also comprise a pulley 340 for the fiber-optic cable 40, designed to transmit motion to the fiber-optic cable 40. This pulley 340 can also be coupled to the lifting crane 305. This pulley 340 allows to transmit the lifting movement of the lifting crane 305 to the fiber-optic cable 40. Thus, when the lifting crane 305 is set in motion, the rotation of the pulley 340 is actuated, which allows the transmission of the lifting movement of the lifting crane 305 to the fiber-optic cable 40.

Furthermore, the fiber-optic cable 40 can be unwound from a reel 350 connected to a lifting apparatus 360. This apparatus 360 is also preferably a winch. This winch can be anchored to the ground by means of an anchor means 370. The winch can also be motorized or not. It allows to control the winding and unwinding of the fiber-optic cable 40. In addition, the winch may comprise a tower counting device for unwinding the fiber-optic cable. This allows the length of the unwound fiber-optic cable to be measured.

The system can comprise a fork 380, designed to hold the holding guides 20 and the stops 30 during assembly. The fork 380 can have at least two arms. It can be placed on the wellhead. This fork 380 is used to retain the holding guides 20 and the stops 30 so that the holding guides 20 and the stops 30 do not fall into the borehole by gravity during assembly.

This assembly system 300 allows to save time when assembling a maintenance device 1 for determining the position of a blockage point 2 of a tubular member 3. Indeed, this system 300 is quick and easy to implement. Moreover, it is simple to use and does not require specific and expensive equipment. Furthermore, the pulleys allow the cables to be unwound. In addition, the fork allows to keep the holding guides and stops resting on it on the surface to prevent them from falling by gravity when not attached to the two cables.

Figure 10:
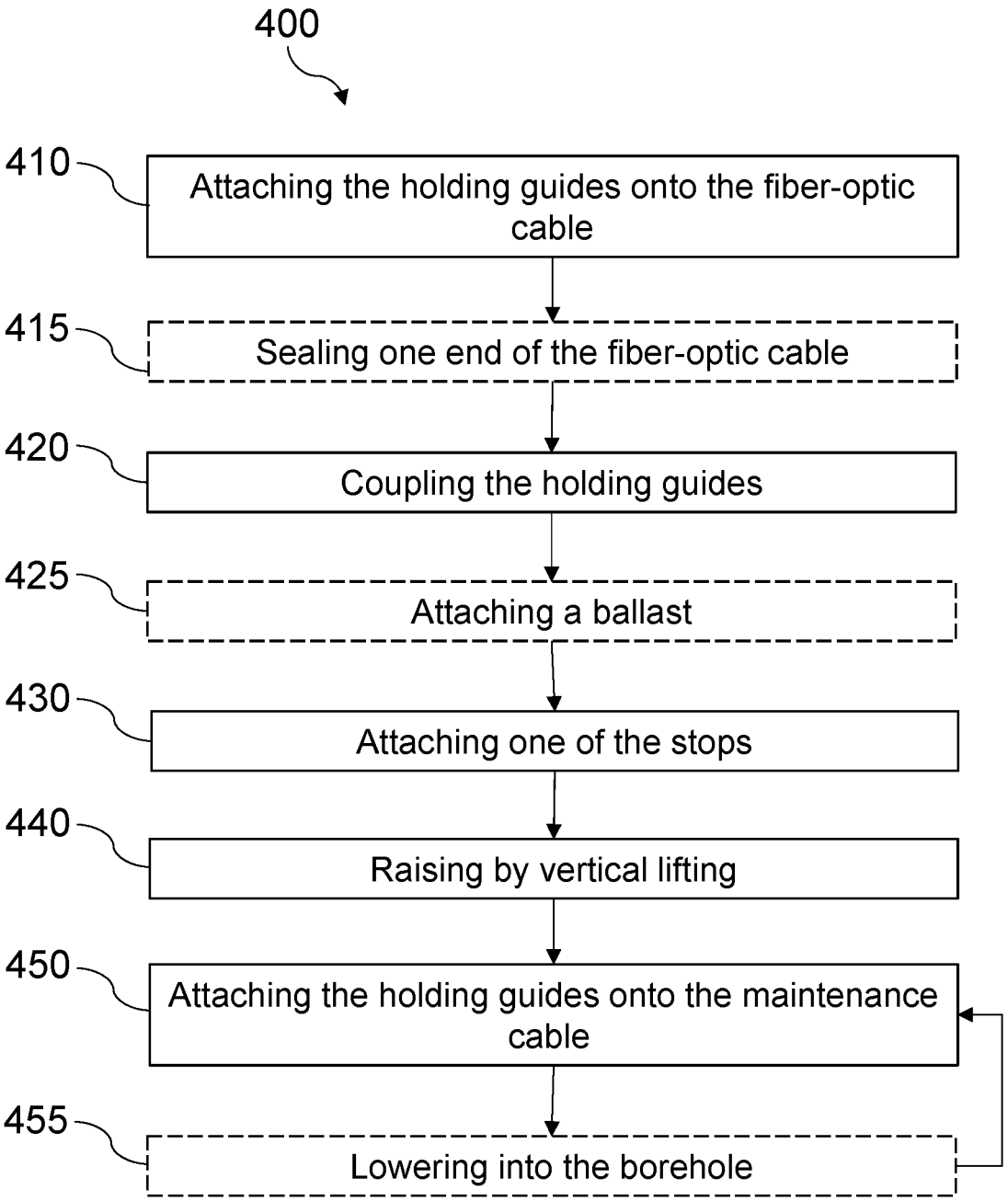
FIG. 10 represents a diagram of an embodiment of the implementation method according to the invention, with the dotted steps being optional.

According to another aspect, the invention relates to a method 400 for setting up a maintenance device 1 for determining the position of a blockage point 2 of a tubular member 3, shown in FIG. 10.

Preferably, the maintenance device 1 is first assembled horizontally with respect to the ground and close to the drill head.

The method may comprise a step 410 of attaching the holding guides to the fiber-optic cable 40. This attachment is preferably fixed and removable between the attachment means 27 of a holding guide 20 and the fiber-optic cable 40.

In addition, during this attachment step, the distance between each holding guide 20 may be undetermined. Indeed, as the attachment is not yet removable at this stage between the holding guides 20 and the fiber-optic cable 40, the distance between each holding guide 20 is not fixed. Furthermore, the means 27 for attaching, preferably by compression, the holding guides 20 is not activated. Thus, the holding guides 20 are close together.

The method, shown in FIG. 10, may comprise a step 415 of sealing one end of the fiber-optic cable 40. Preferably, the end is the end of the fiber-optic cable that will enter the borehole first. This allows to limit, on the one hand, the movement of the fiber-optic cable by preventing the fiber-optic cable from being released from the attachment means and also allows, on the other hand, the fiber-optic cable to withstand the environmental conditions of pressure, temperature, and chemistry of the borehole.

A method according to the invention may comprise a step 420 of coupling the holding guides 20 with the safety cable 10.

This step may also comprise the assembly of the safety cable 10 with the stops 30. Indeed, each holding guide 20 can be positioned between at least one stop 30. Alternatively, each holding guide 20 can be positioned between an upstream stop 30 and a downstream stop 30. The upstream stop 30 and the downstream stop constitute one pair of stops of the plurality of pairs of stops. In addition, the system of attachment by compression of each stop may not be activated. This allows the safety cable to slide freely between each stop and each holding guide.

Such a method may comprise a step 425 of attaching one or more ballasts to one end of the safety cable 10. Preferably the end is the end that will enter the tubular member 3 first. In addition, the one or more ballasts attached to the safety cable 10 can be close to a stop 30.

A method according to the invention may comprise a step 430 of attaching one of the stops to the safety cable 10. The stop in the immediate vicinity of the ballast 50 can be attached to the safety cable 10 by means of a compression attachment. Preferably, the stop 30 attached onto the safety cable 10 is the stop in the immediate vicinity of the one or more ballasts 50. This allows the set of stops 30 and the plurality of holding guides 20 to be held onto the safety cable 10 when it is lifted to enter the tubular member 3.

A method according to the invention may comprise a step 440 of raising by vertically lifting the entire maintenance device 1. Thus, the assembly of the fiber-optic cable 40, the safety cable 10, the plurality of holding guides 20, the plurality of stops 30, and the ballasts 50, can be lifted vertically by the lifting crane 305. The assembly can be placed at the drill head.

Thanks to the simple coupling of the holding guides 20 onto the safety cable 10 and the plurality of stops 30, under the effect of gravity, the holding guides 20 and the stops 30 can slide along the safety cable 10. All the stops and holding guides can then rest on the only stop attached to the safety cable, namely the stop in the immediate vicinity of the one or more ballasts 50. This makes it easier to maintain and transport the maintenance device 1 to the wellhead.

Also to facilitate holding and transporting the maintenance device 1 to the drill head, the fiber-optic cable 40 can be placed on the pulley 340 for the fiber-optic cable and the safety cable 10 on at least one pulley 311, 312 for the safety cable. The maintenance device 1 can be lifted vertically to a height that allows the one or more ballasts 50 to be placed inside the borehole. The height depends on the length of the maintenance device 1.

Furthermore, in order to hold the plurality of holding guides 20 and the plurality of stops 30 which rest on the only stop attached to the safety cable, the fork 380 can be placed on the wellhead. This allows to hold on the surface the holding guides and the stops which therefore rest on the fork. Preferably, the fork 380 is placed under the stop 30 closest to the one or more ballasts 50 which is attached to the safety cable 10.

A method according to the invention may comprise a step 450 of attaching the holding guides to a maintenance device 1. To this end, the method may comprise a step 455 of lowering the maintenance device 1 into the borehole. Lowering the maintenance device 1 can be carried out by means of a logging unit. In addition, the maintenance device 1 can be lowered 10 meters into the shaft. The one or more stops 30 of the holding guide 20 closest to the one or more ballasts 50 can then be attached to the safety cable 10. Furthermore, the fiber-optic cable 40 can be attached to the holding guide 20 by attaching, preferably by a compression attachment.

Once the one or more stops 30 have been attached onto the safety cable 10 and the holding guide 20 has been attached onto the fiber-optic cable 40, a lowering step 455 can be carried out again by the logging unit. The maintenance device 1 is preferably lowered into the borehole again, for example by 10 meters. Lowering the device is done depending on the desired spatial resolution, so the device can be lowered by more or less 10 meters.

The step of attaching 450 the holding guides onto the maintenance device can be repeated until the entire plurality of holding guides are attached to the fiber-optic cable.

A method 400 for setting up is quick and easy to implement with a reduced number of steps, and allows cost control, in particular thanks to the material used but also thanks to the reduction of assembly time near the drilling site.

According to another aspect, the invention relates to a tubular member 3 comprising a maintenance device 1, preferably arranged inside the tubular member 3, for determining the position of a blockage point 2 of said tubular member.

A tubular member 3 equipped with a maintenance device 1 may comprise a safety cable 10, a plurality of holding guides 20, a plurality of stops or a plurality of pairs of stops 30, and a fiber-optic cable 40. This tubular member 3 allows a precise, reliable, and accurate determination of a blockage point 2. In addition, such a tubular member 3 is safe for subsoil exploitation.

As presented, the invention makes it possible to determine the position of the blockage point 2 of a tubular member 3 in a safe, fast, and simple manner. In fact, it is possible to check a hundred meters of a tubular member 3 in a single measurement. This allows to save time during the implementation of the invention. In addition, the measurements are reliable, simple, and precise. Furthermore, the invention allows to save time by carrying out a single set of measurements, due to its equipment and installations. In addition, the drilling rig is not immobilized for a long period of time. The invention is also less expensive because of its equipment and the reduction of drilling downtime. Moreover, the invention is particularly secured by all its equipment and advantageously safe by the absence of an active sensor and therefore without any electrical system or device.

The invention claimed is:

1. A maintenance device for determining a position of a blockage point of a tubular member, the maintenance device comprising:

a fiber-optic cable, and a plurality of holding guides, each holding guide being attached to the fiber-optic cable, and comprising attachment means configured to be removably attachable to an inner wall of the tubular member.

2. The maintenance device according to claim 1, further comprising a safety cable, wherein each holding guide is arranged so as to allow a translational movement of the holding guides with respect to the safety cable.

3. The maintenance device according to claim 2, wherein the safety cable has a tensile strength of more than 1 kN and is configured to withstand at least a force that is equal to a maximum force applied to the maintenance device plus a predetermined safety coefficient.

4. The maintenance device according to claim 2, wherein the safety cable has a length between 10 meters and 5000 meters.

5. The maintenance device according to claim 2, wherein the safety cable is a cable made of steel, composite materials, or textile materials.

6. The maintenance device according to claim 2, further comprising a plurality of stops, each stop being coupled to the safety cable and to one of the holding guides so as to limit the movement of said holding guide with respect to the safety cable.

7. The maintenance device according to claim 2, further comprising a plurality of pairs of stops, each stop of each said pair of stops being coupled to the safety cable and being positioned on either side of one of the holding guides, respectively, so as to limit the movement of said holding guide with respect to the safety cable.

8. The maintenance device according to claim 2, further comprising a plurality of stops, wherein each stop is positioned upstream and/or downstream of each holding guide.

9. The maintenance device according to claim 8, wherein a coupling of each stop to the holding guide is direct, removable and extensible.

10. The maintenance device according to claim 1, wherein each holding guide comprises a conduit formed in the holding guide to accommodate a safety cable.

11. The maintenance device according to claim 10, wherein the conduit formed in each said holding guide to accommodate the safety cable protrudes into the holding guide along an entire length of the holding guide.

12. The maintenance device according to claim 10, wherein the conduit formed in each said holding guide to accommodate the safety cable protrudes into the holding guide at a center of the holding guide.

13. The maintenance device according to claim 1, wherein the attachment means comprises at least one of the following: an anchor, a moving arm, a clamp, a packer, a permanent magnet, an electrostatic device, an electromagnetic device, an electromagnet, a temporary adhesive, glue, tape or an adhesive for attaching the holding guide to inner wall of the tubular member.

14. The maintenance device according to claim 1, wherein each holding guide comprises a central portion that is configured to be attachable to the inner wall of the tubular member at a periphery of the central portion.

15. The maintenance device according to claim 1, wherein the attachment means comprises at least one of the following: a magnet, a plurality of magnets, permanent magnets, electromagnets, plasty-magnets, moving members, or combinations thereof, configured to attach to the tubular member.

16. The maintenance device according to claim 1, wherein each holding guide comprises a conduit adapted to accommodate the fiber-optic cable.

17. The maintenance device according to claim 1, wherein the holding guides are spaced apart from each other by a distance of the order of the size of a section of the tubular member.

18. The maintenance device according to claim 17, wherein a holding guide is spaced between 2 and 20 meters from the next holding guide.

19. A system for determining a position of a blockage point of a tubular member, comprising a reflectometry distributed measurement device and the maintenance device according to claim 1, said reflectometry distributed measurement device being connected to the maintenance device and configured to carry out a measurement of deformation of the tubular member.

20. A method for determining a position of a blockage point of a tubular member by means of a maintenance device comprising a fiber-optic cable and a plurality of holding guides, each holding guide being attached to the fiber-optic cable and including an attachment means configured to be removably attachable to an inner wall of the tubular member, the maintenance device being inserted into the tubular member and the holding guides being attached to the tubular member by means of the attachment means, said method comprising:

taking a first reflectometry distributed measurement, applying a stress to the tubular member or removing a stress applied to the tubular member prior to the first reflectometry distributed measurement, taking a second reflectometry distributed measurement, and determining the position of the blockage point of the tubular member by comparing the first and second reflectometry measurements.

21. The method for determining a position of a blockage point according to claim 20, wherein the first and second reflectometry distributed measurements each include calculating Brillouin backscattering in the optical fiber by means of a deformation distributed measurement device.

22. A tubular member comprising the maintenance device according to claim 1 for determining a position of a blockage point of said tubular member.

* * * * *